US011501901B2

(12) United States Patent
Tang et al.

(10) Patent No.: US 11,501,901 B2
(45) Date of Patent: Nov. 15, 2022

(54) MAGNET DESIGN

(71) Applicant: SCHLUMBERGER TECHNOLOGY CORPORATION, Sugar Land, TX (US)

(72) Inventors: Yiqiao Tang, Chongqing (CN); Irfan Bulu, Brighton, MA (US); Yi-Qiao Song, Newton Center, MA (US); Mark Flaum, Houston, TX (US); Tancredi Botto, Cambridge, MA (US); Shin Utsuzawa, Arlington, MA (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 447 days.

(21) Appl. No.: 16/339,862

(22) PCT Filed: Oct. 5, 2017

(86) PCT No.: PCT/US2017/055236

§ 371 (c)(1),
(2) Date: Apr. 5, 2019

(87) PCT Pub. No.: WO2018/067767

PCT Pub. Date: Apr. 12, 2018

(65) Prior Publication Data

US 2019/0244737 A1 Aug. 8, 2019

Related U.S. Application Data

(60) Provisional application No. 62/504,931, filed on May 11, 2017, provisional application No. 62/404,575, filed on Oct. 5, 2016.

(51) Int. Cl.
*H01F 7/02* (2006.01)

(52) U.S. Cl.
CPC ..... *H01F 7/021* (2013.01); *H01F 7/0278* (2013.01)

(58) Field of Classification Search
CPC ..... H01F 7/021; H01F 7/0278
See application file for complete search history.

(56) References Cited

U.S. PATENT DOCUMENTS 1,895,129 A * 1/1933 Jones ..... B23Q 3/154 335/285
4,355,236 A * 10/1982 Holsinger ..... H05H 7/04 250/396 ML
5,194,810 A * 3/1993 Breneman ..... G01R 33/383 324/319

(Continued)

FOREIGN PATENT DOCUMENTS

CN 201180098 Y 1/2009
CN 102360717 A 2/2012

(Continued)

OTHER PUBLICATIONS ip.com Search Results.*

(Continued)

*Primary Examiner* — Mohamad A Musleh
(74) *Attorney, Agent, or Firm* — Trevor G. Grove

(57) ABSTRACT

Magnet design is provided. A method customizes a magnetic field uniformity of a magnet by introducing one or more gaps between pieces of the magnet assembly.

14 Claims, 28 Drawing Sheets

(56) References Cited

U.S. PATENT DOCUMENTS

| | | | | |
|---|---|---|---|---|
| 6,104,108 | A * | 8/2000 | Hazelton | G03F 7/70758 310/12.06 |
| 6,841,910 | B2 * | 1/2005 | Gery | H02K 49/106 310/103 |
| 7,570,142 | B2 * | 8/2009 | Makita | C22C 33/0278 315/501 |
| 8,917,154 | B2 * | 12/2014 | Fullerton | H01F 7/0278 335/296 |
| 10,624,200 | B2 * | 4/2020 | Qiao | H05H 13/04 |
| 2004/0263303 | A1 | 12/2004 | Kuriyama et al. | |
| 2005/0242912 | A1 | 11/2005 | Chell et al. | |
| 2006/0232368 | A1 | 10/2006 | Gorshkov | |
| 2013/0009735 | A1 | 1/2013 | Nath et al. | |
| 2015/0302984 | A1 | 10/2015 | Kurs | |

FOREIGN PATENT DOCUMENTS

| | | | |
|---|---|---|---|
| CN | 101343998 | B | 5/2012 |
| GB | 783603 | A | 9/1957 |
| WO | 2007033437 | A1 | 3/2007 |

OTHER PUBLICATIONS

Global Dossier Report.*

Danieli, E. et al. "Small Magnets for Portable NMR Spectrometers", Angewandte Chemie International Edition, 2010, 49(24), pp. 4133-4135.

Parker, A. J., et al. "Shimming Halbach magnets utilizing genetic algorithms to profit from material imperfections." Journal of Magnetic Resonance, 2016, 265, pp. 83-89.

Nath, P., et al. "The "Shim-a-ring" magnet: Configurable static magnetic fields using a ring magnet with a concentric ferromagnetic shim", Applied Physics Letters, 2013, 102(20), pp. 202409 (4 pages).

Office Action in Chinese Patent Application No. 2017800681531 dated Nov. 3, 2020; 13 pages (with English Translation).

Office Action in Chinese Patent Application No. 2017800681531 dated Jul. 24, 2021; 8 pages (with English Translation).

3rd Office Action issued in Chinese Patent Application No. 2017800681531 dated Dec. 7, 2021, 12 pages with partial English translation.

* cited by examiner

| | |
|---|---|
| ba_1 | 0.039548 |
| ba_2 | 0.0410848 |
| ba_3 | 0.0426217 |
| ba_4 | 0.0441585 |
| ba_5 | 0.0456953 |
| ba_6 | 0.0472322 |
| ba_7 | 0.048769 |
| ba_8 | 0.0503058 |
| ba_9 | 0.0518427 |
| ba_10 | 0.0533795 |
| ba_11 | 0.0549163 |
| ba_12 | 0.0564532 |
| ba_13 | 0.05799 |
| ba_14 | 0.072764 |
| ba_15 | 0.0778235 |
| ba_16 | 0.082883 |
| ba_17 | 0.0879425 |
| ba_18 | 0.093002 |
| ba_19 | 0.0980615 |
| ba_20 | 0.103121 |
| ba_21 | 0.1081805 |
| ba_22 | 0.11324 |

MAGNET DESIGN

PRIORITY

This application claims priority from U.S. Provisional Patent Application Nos. 62/404,575 and 62/504,931, the disclosures of which are hereby incorporated by reference herein in their entireties.

BACKGROUND

In the field of magnetic resonance, ensuring high field uniformity is often a priority, as field uniformity can affect a number of properties including chemical shift resolution, relaxation time accuracy, and motion artifacts in a magnetic resonance logging tool. Designing such a uniform field region using permanent magnets often involves large quantities of high grade magnetic material, carefully screened to ensure conformity with modeling. This process can result in magnets that are expensive, difficult to manufacture, and which are typically significantly larger than the uniform field region they generate.

SUMMARY

This summary is not intended to identify key or essential features of the claimed subject matter, nor is it intended to be used as an aid in limiting the scope of the claimed subject matter.

Magnet assemblies are provided. In one embodiment, a magnet assembly includes a plurality of magnets (components) of uniform shape, magnetization and size which are separated by gaps between the components where the gap sizes are selected to increase the uniformity of the magnetic field of the assembly along an axis relative to a similar magnet assembly without gaps.

In one embodiment, a magnet assembly includes multiple single or sets of rectangular magnets, each single magnet or set of rectangular magnets being of uniform size, shape, and magnetization with each magnet or set spaced from an adjacent magnet or set by a spacing which increases in size from the center of the assembly to the end of the assembly resulting in an assembly that provides a more uniform field than a similar assembly where the magnets or sets are not spaced apart. In one embodiment, the sets of magnets may be arranged in a U-shaped assembly defining a channel, and a U-shaped shield located in the channel is provided. A magnetic core element around which a coil may be wound may be located inside the shield. The arrangement provides an electromagnetic assembly which is particularly useful in NMR experiments and measurements, although it is not limited thereto.

In another embodiment, a magnet assembly includes multiple toroidal magnets or multiple sets of magnets arranged toroidally, with the toroidal magnets or magnet sets being of uniform cross-section and spaced from each other by at least one gap to increase the uniformity of the magnetic field of the assembly along an axis relative to a similar magnet or magnet assembly without gaps. In some embodiments, the assembly includes a plurality of toroidal magnets spaced by a plurality of gaps.

In other embodiments, one or more toroidal magnets or sets of magnets arranged toroidally are surrounded by a ferromagnetic shield (in a shim-a-ring arrangement) but with the shield having one or more gaps therein where the gap size(s) is/are selected to increase the uniformity of the magnetic field of the assembly along an axis relative to a similar magnet assembly having a shield without gaps. In some embodiments, the gap or gaps may be circumferential, i.e., extending normal to and around the toroidal axis. In some embodiments, the gap or gaps may be radial, i.e., extending parallel to the toroidal axis at one or more locations. In some embodiments, both circumferential and radial gaps in the shield may be utilized.

In some embodiments, methods are provided for designing and generating magnet assemblies. In one method, magnetization simulation software is utilized to find an expected magnetic field that is produced from a linear magnet, and a spacing regime is generated from a profile of the expected magnetic field. The spacing regime is optionally utilized in an iteration of the simulation software which is provided multiple identical magnets with the spacing regime to generate a new expected magnetic field. Additional iterations may be utilized to optimize the expected magnetic field by modifying the spacing regime to an optimized spacing regime. A magnet assembly with multiple identical magnets arranged linearly according to the spacing regime dictated by the expected magnetic field profile or the optimized spacing regime.

In another method, a magnet assembly is obtained having one or more toroidal magnets or sets of magnets arranged toroidally and surrounded by a ferromagnetic shield (in a shim-a-ring arrangement), and the magnetic field of the magnet assembly is tested. The shield of the magnet is then modified by cutting it to generate one or more circumferential and/or radial gaps where the gap locations and sizes are selected to increase the uniformity of the magnetic field of the assembly.

BRIEF DESCRIPTION OF THE DRAWINGS

Features and advantages of the described implementations can be more readily understood by reference to the following description taken in conjunction with the accompanying drawings.

DETAILED DESCRIPTION

In the following description, numerous details are set forth to provide an understanding of some embodiments of the present disclosure. However, it will be understood by those of ordinary skill in the art that systems and/or methodologies may be practiced without these details and that numerous variations or modifications from the described embodiments may be possible.

Additionally, some examples discussed herein involve technologies associated with the oilfield services industry. It will be understood however that the techniques of magnet design may also be useful in a wide range of other industries outside of the oilfield services sector, including for example, mining, geological surveying, chemical processing, etc.

In one aspect, various techniques and technologies associated with magnet design can be used to, for example, design permanent magnets with a desired spatial field distribution over a certain volume at a given budget cost. For example, when a permanent magnet is utilized in a nuclear magnetic resonance (NMR) probe such as a contact probe, a fluid analysis probe or a logging tool, desirable spatial distributions of magnetic field can sometimes include surfaces of constant uniform field and/or surfaces of constant field gradient along a certain direction, i.e. surfaces that can be described as having C1, C2 continuity (not limited to higher order). In cases when the NMR probe or the sample being analyzed is also moving, it may also be desirable to shape the magnetic field distribution along the direction of motion, such as to provide for a desirably smooth transition between a pre-polarization field region (e.g. a high field region) and a sense field region (e.g. a saddle point or gradient region). In one possible implementation, a smooth profile may be desired to preserve the sample polarization, i.e. introduce adiabatically slow perturbations during probe motion.

It should be appreciated that arbitrary field distributions may not be had with permanent magnets having simple geometrical forms. In addition, in certain environments, e.g. in an NMR logging tool, the magnet may need to conform to a certain housing and/or shape contours, which may further constrain the design space. In some embodiments, some advanced magnet assemblies may comprise multiple magnetic blocks, with different shapes polarized along different directions (e.g. the magnet assembly used in Combinable Magnetic Resonance (a trademark of Schlumberger) (CMR) tool), wherein the magnetic blocks are combined to form an overall rigid assembly where the individual pieces are held closely packed together with the help of supports, glues, other joining techniques, and/or the magnetic force between components.

Figure 1A:
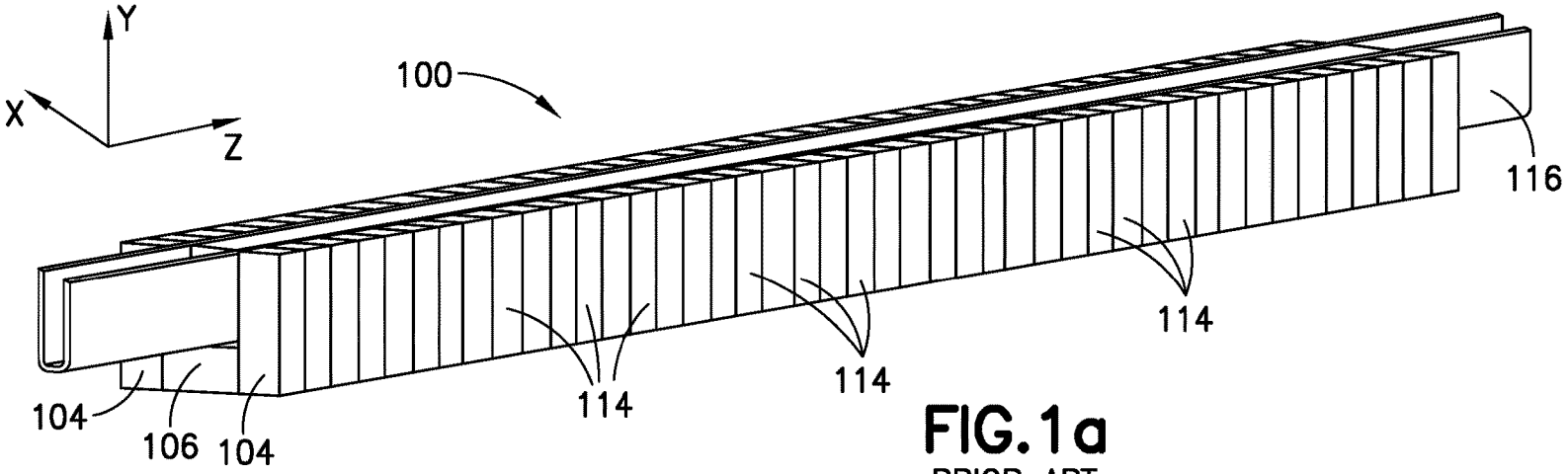
FIG. 1a PRIOR ART
FIGS. 1*a* and 1*b* are respectively a perspective view of a prior art multi-component magnet assembly, based on a repeated unit structure with a three magnet block, and a cross-sectional view therethrough.
Figure 1B:
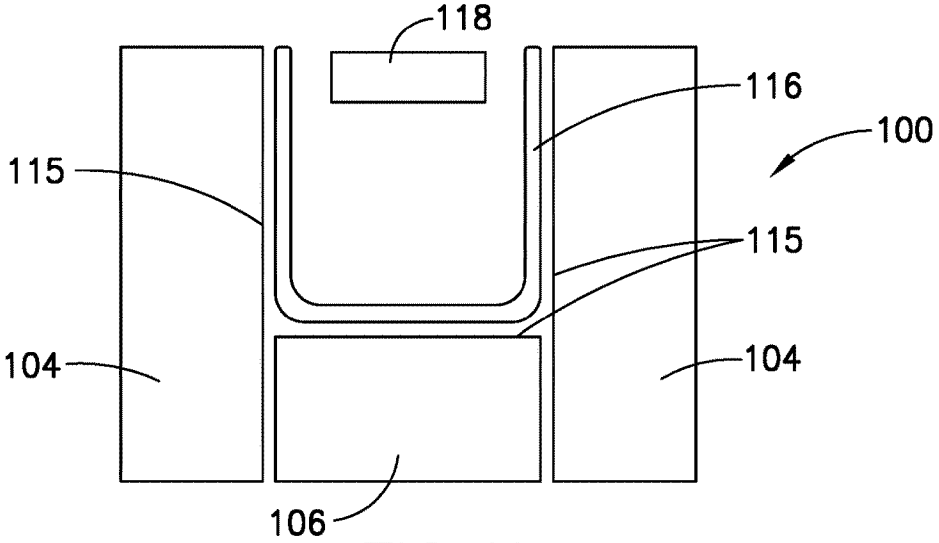
FIG. 1b PRIOR ART

Before turning to various embodiments, it is useful to review a prior art design. FIGS. 1*a* and 1*b* are respectively a perspective view of a prior art multi-component magnet assembly 100. Assembly 100 is based on a repeated unit structure that has a three magnet U-shaped block (taller side magnets 104 and a shorter middle or bottom magnet 106) which produces a saddle point magnetic field. The magnet assembly 100 seen in FIGS. 1*a* and 1*b* can be used, for example, with NMR for well logging. In one possible implementation, side magnets 104 can have a 1-by-1 inch cross-section and be 2.75-inches long, though other dimensions of side magnets 104 may also be used. Bottom magnet 106 may have a 1-by-1 inch cross-section and be 1-inches long, though other dimensions of bottom magnet 106 may also be used. In one possible aspect, the three pieces (i.e. side magnets 104 and bottom magnet 106) can be glued together to form a segment or a unit cell. Thirty segments 114 of magnet 100 are shown in FIG. 1*a*, although more or fewer segments 114 may also be used. The segments 114 define a U-shaped channel 115.

In one possible embodiment, with every magnet segment 114 glued to an adjacent segment, the entire assembly can be treated as a single long magnet 100 of a uniform magnetization in the middle. In one possible aspect, this magnet profile can be similar in CMR.

As seen in prior art FIGS. 1*a* and 1*b*, a U-shaped shield 116 may be placed inside the U-shaped channel defined by the segments 114. The shield 116 extends around a core 118 and at least a portion of a coil (not shown). The shield 116 may be glued in place in the channel 115.

Figure 2A:
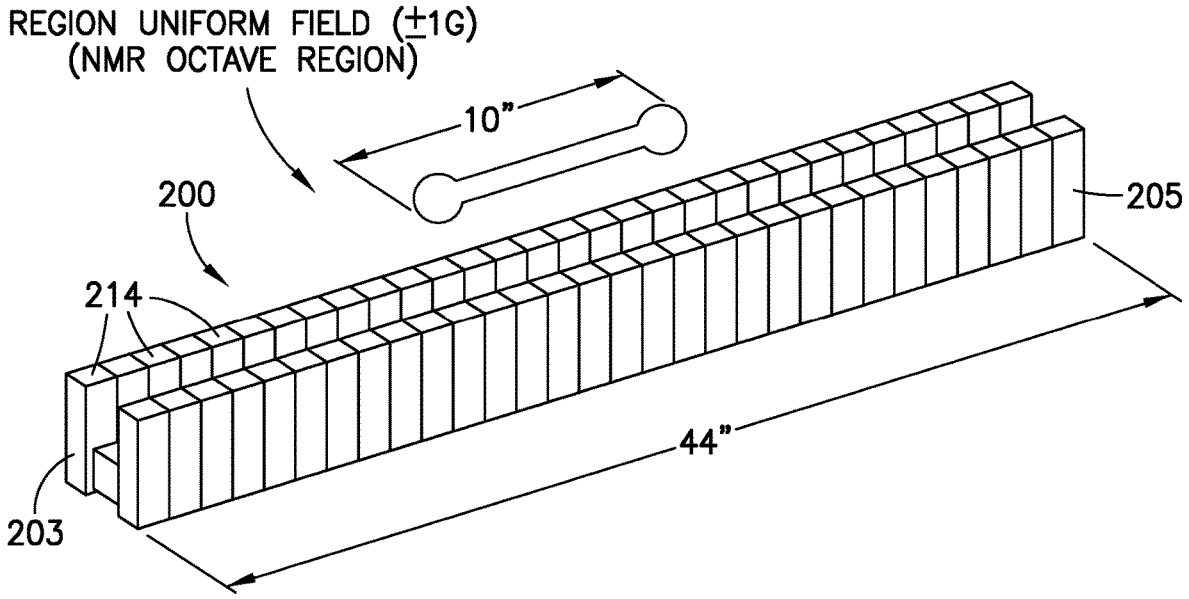
FIG.2a PRIOR ART
FIGS. 2*a* and 2*b* illustrate respectively a prior art multi-component magnet assembly as in FIG. 1*a* of a particular length and a typical field profile of that assembly.
Figure 2B:
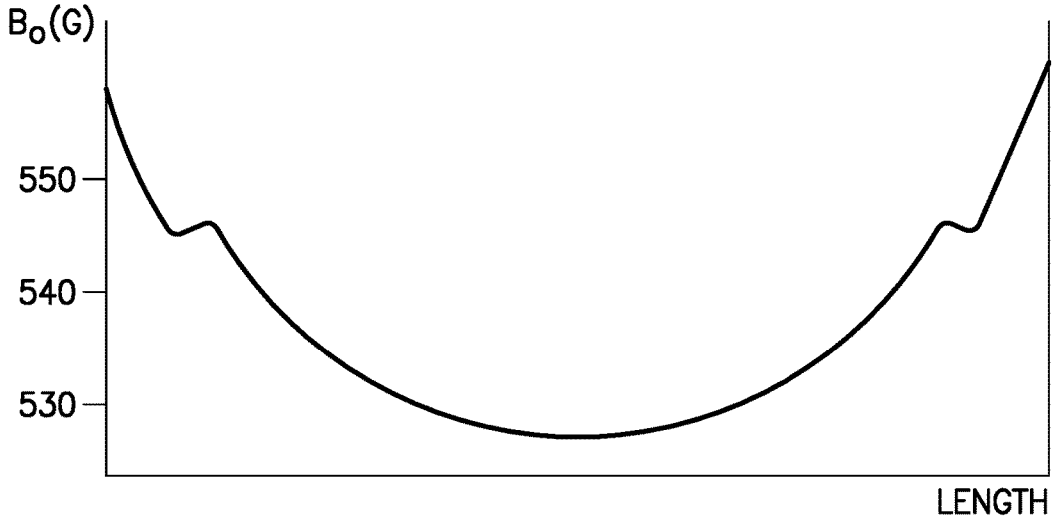
FIG.2b PRIOR ART

Prior art FIG. 2*a* shows a magnet assembly 200 similar to that of FIG. 1*a* with forty-four magnet segments 214, having a total length of forty-four inches. FIG. 2*b* illustrates a field profile along the z-axis (i.e., the axis of the channel) at a saddle point above the top of magnet assembly 200, with field strength $B_o$ varying from 530 G to 560 G along the z axis. Due to edge effects, the magnetic field rises towards both ends 203, 205 of the magnet assembly 200, and the uniform field region (i.e., the region having a field that varies by less than or equal to 1 G (±1 G)) close to the middle of the assembly 200 is limited to about ten inches. It is noted that the shoulders in the magnetic field curve of FIG. 2*b* relate to a shield that is not shown in FIG. 2*a*.

Figure 3A:
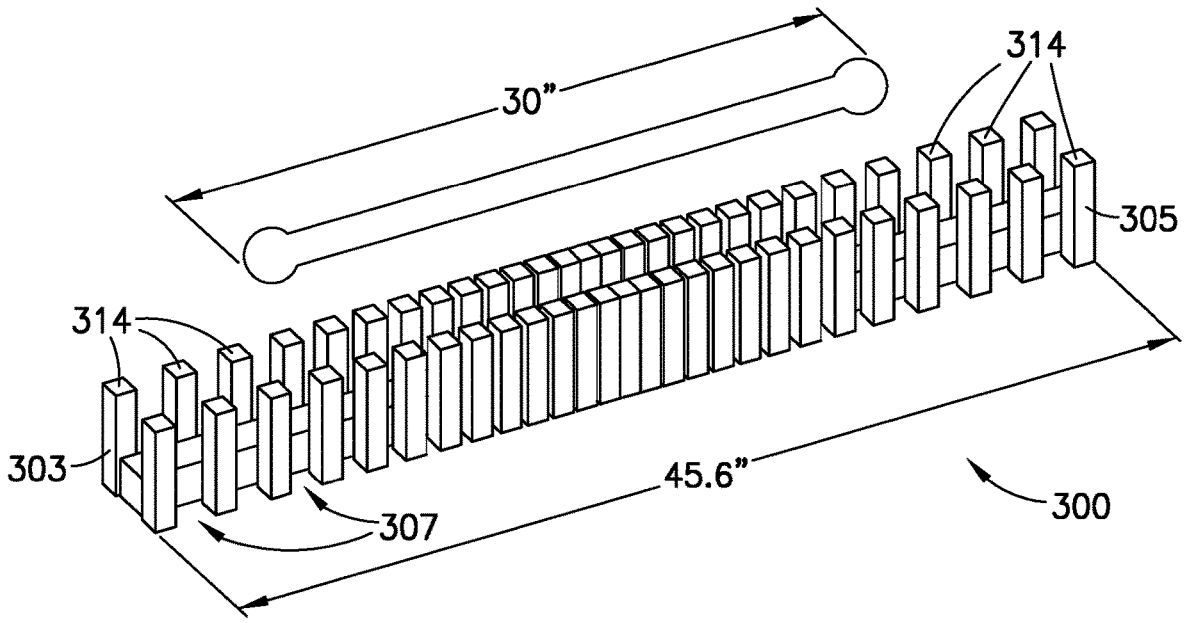
FIGS. 3*a* and 3*b* illustrate respectively a multi-component magnet assembly with selected increasing gap sizes between components and a resulting field profile of the assembly.
Figure 3B:
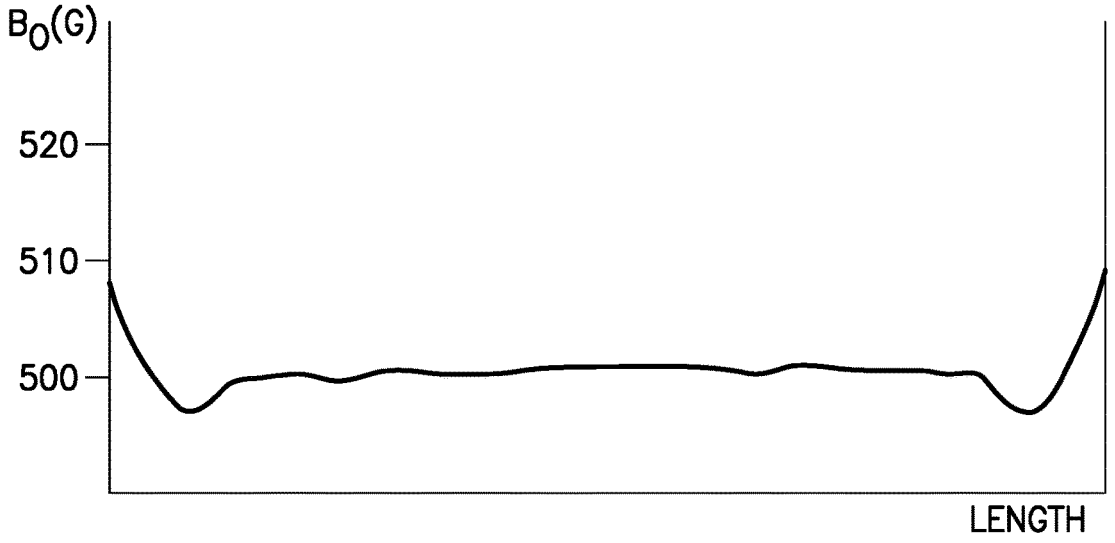
Figure 3C:
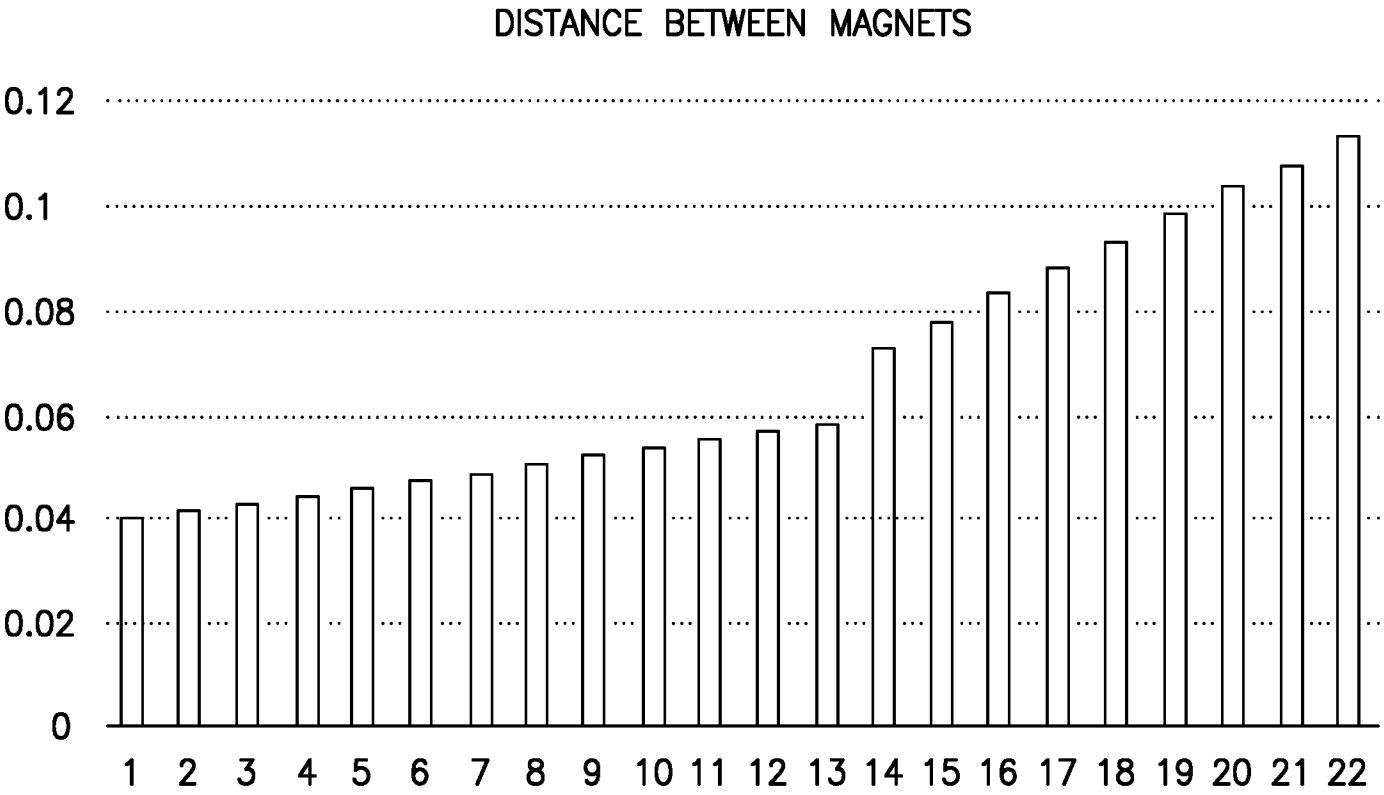
FIG. 3*c* is a chart of the gap sizes of the magnet assembly of FIG. 3*a;*

Turning now to new embodiments, a magnet assembly 300 is seen that utilizes forty-four U-shaped magnet segments 314 of a uniform size, shape, and magnetization which are the same size, shape, and magnetization as that of magnet assembly 200 of FIG. 2*a*. However, unlike segments 214 of magnet assembly 200, the segments 314 of assembly 300 are arranged to include gaps 307 between adjacent segments 314. The gap may be an air gap and/or a gap formed from other non-permeable, and non-magnetic materials such as, by way of example only, glue, plastic, and aluminum. In the embodiment of FIG. 3*a*, the gaps increase in size from the center of the assembly to the end of the assembly. By way of example, the spacing is arranged with increasing gap sizes from the middle out (gaps in one direction being shown in FIG. 3*c*) so that the total length of the assembly 300 is 45.6 inches. With the provided arrangement, a more uniform magnetic field is generated. More particularly, the field profile of magnet assembly 300 along the z-axis (i.e., the axis of the channel) at a saddle point above the top of magnet 300 is seen in FIG. 3*b* with a field strength $B_o$ varying from 497 G to 510 G along the z axis. The field strength along the middle thirty inches of the assembly is seen to be steady at approximately 500 G (±1 G). Thus, by adding selected gaps between the adjacent segments 314, increasing in size from the middle out toward the ends 303, 305, an assembly of a slightly increased length (by under 4%) is able to generate a magnetic field that is uniform for an increased length of approximately 200% (from ten inches to thirty inches).

It will be appreciated that the increasing width of gaps between adjacent segments can be utilized where there are four segments or more.

Figure 4A:
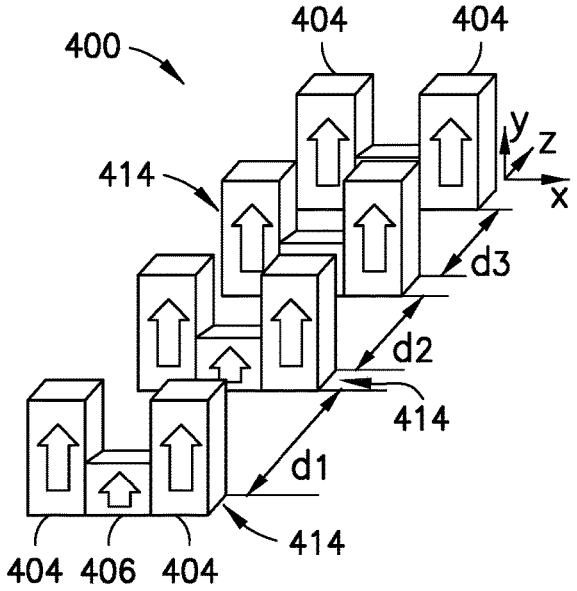
FIGS. 4*a* and 4*b* illustrate respectively an exemplary magnet assembly distributed with gaps along a z-axis, and field profiles for the assembly with no gaps and with selected gap sizes.
Figure 4B:
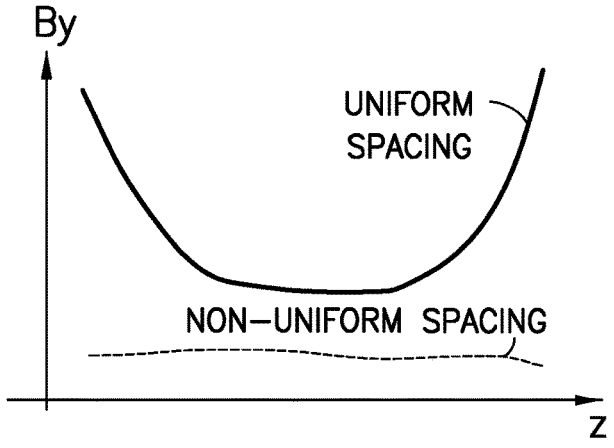
Figure 5A:
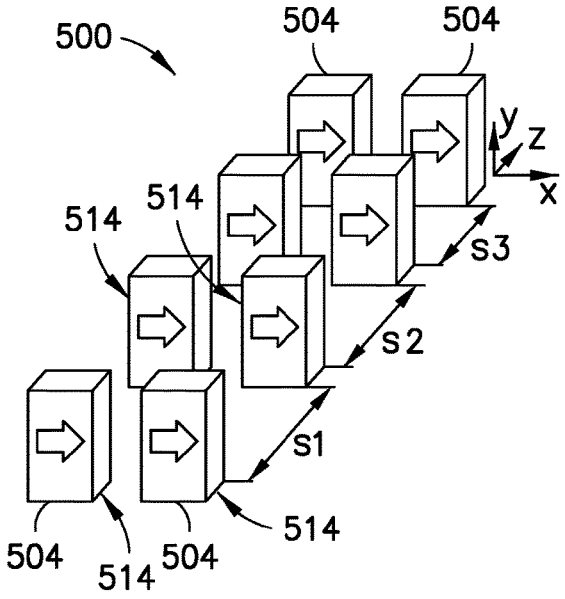
FIGS. 5*a* and 5*b* illustrate another exemplary magnet assembly distributed with gaps along a z-axis, and field profiles for the assembly with no gaps and with selected gap sizes.
Figure 5B:
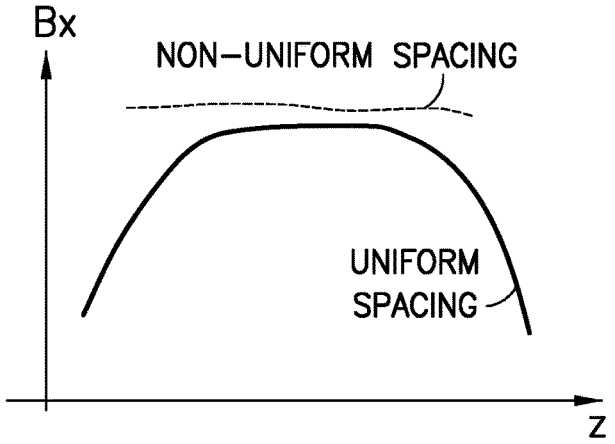

Turning to FIGS. 4*a*, 4*b* and FIGS. 5*a* and 5*b*, it should be appreciated that the segments that make up a magnet assembly may take different formats and may be polarized in different directions. Thus, as seen in FIG. 4*a*, a magnet assembly 400 includes U-shaped segments 414 which are comprised of side magnets 404 and a bottom magnet 406 which are polarized in a parallel manner in the y-direction, whereas in FIG. 5*a*, a magnet assembly 500 includes segments 514 comprised of magnets 504 which are polarized in a collinear manner in the x-direction. More particularly, as with the segments 314 of magnet assembly 300, the segments 414 of assembly 400 are nominally identical (in size, shape and magnetization) and are distributed along a z-axis with spacings (gaps) d1, d2, d3, chosen to make the resulting field as uniform as possible. The magnetic field of the magnet assembly 400 without gaps is compared to the magnetic field with an optimized spacing in FIG. 4*b*. It will be understood that other shapes of magnetic blocks may also be used (such as, for example, rounded shapes, etc.) in order to satisfy various purposes (e.g. to fit in a tool, etc.). It will also be appreciated that the various spacings d1, d2, do can be chosen to increase or decrease, in order to maximize the extent of the uniformity of the field along the z-axis. Similarly, the segments 514 of assembly 500 are nominally identical and distributed along a z-axis with spacings (gaps) s1, s2, s3, chosen to make the resulting field as uniform as possible. The magnetic field of the magnet assembly 500 with uniform spacing is compared to the magnetic field with desired non-uniform spacing in FIG. 5*b*. It will be understood that other shapes of magnetic blocks may also be used (such as, for example, rounded shapes, etc.) in order to satisfy various purposes (e.g. to fit in a tool, etc.). It will also be appreciated that the various separations s1, s2, . . . sn can be chosen to increase or decrease, in order to maximize the extent of the uniformity of the field along the z-axis.

Figure 6A:
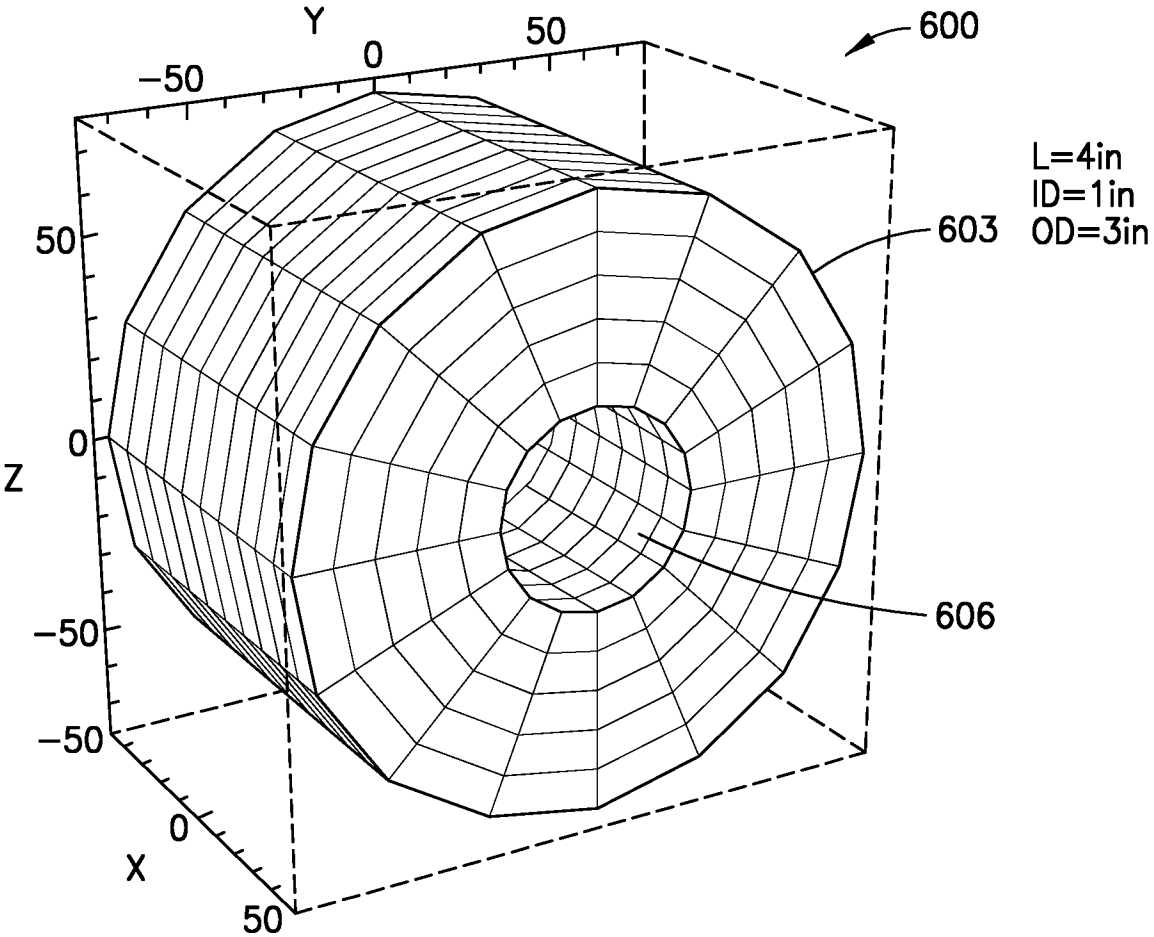
FIG.6a PRIOR ART
FIGS. 6*a*, 6*b* and 6*c* illustrate a prior art toroidal Halbach magnet, and example field and delta field profiles for the prior art toroidal Halbach magnet.
Figure 6B:
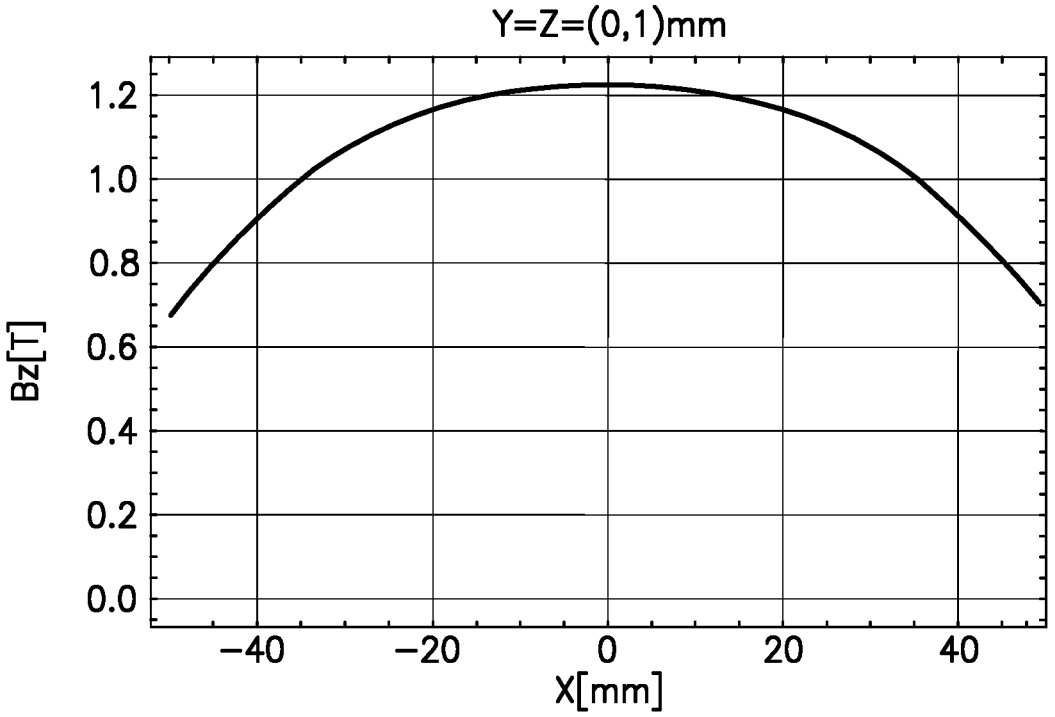
Figure 6C:
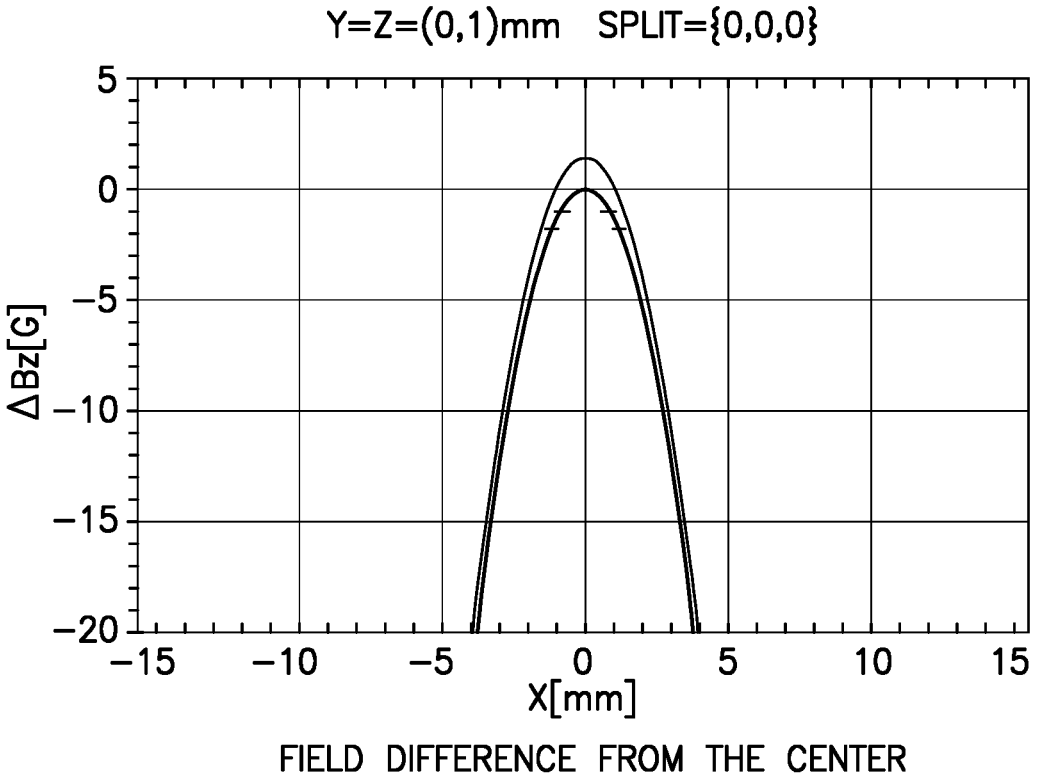

In FIG. 6*a* a prior art magnet 600 is illustrated that is in a Halbach arrangement of annular shape. The magnet 600 is generally toroidal and can be made of a plurality of generally identical wedge-shaped elements. While the outer surface 603 of magnet 600 is shown as being polygonal (flat outer edges), it will be appreciated that a polygonal surface generally approximates a round surface when a sufficient number of edges are provided, and for purposes hereof, the two will be considered equivalent and the magnet 600 will be described as being cylindrical or toroidal. The magnet 600 is shown as having a three-inch outer diameter, a one-inch inner diameter (i.e., defines a one-inch cylindrical central hole 606) and a length of four inches. The magnetic field Bz along the x axis (the axis of the central hole) resulting from the magnet 600, i.e., the field strength profile, is shown in FIG. 6*b* and varies from approximately 0.65 Tesla to 1.22 Tesla. The field difference profile (delta field) from the center of the magnet is shown in FIG. 6*c* and quickly reaches −20 Gauss at 4 mm (about 0.1 inch) from the center. If a uniform field is considered to be a delta of 1 Gauss, it is seen that magnet 600 provides a uniform field for only about 1 mm on each side of the center.

Figure 7A:
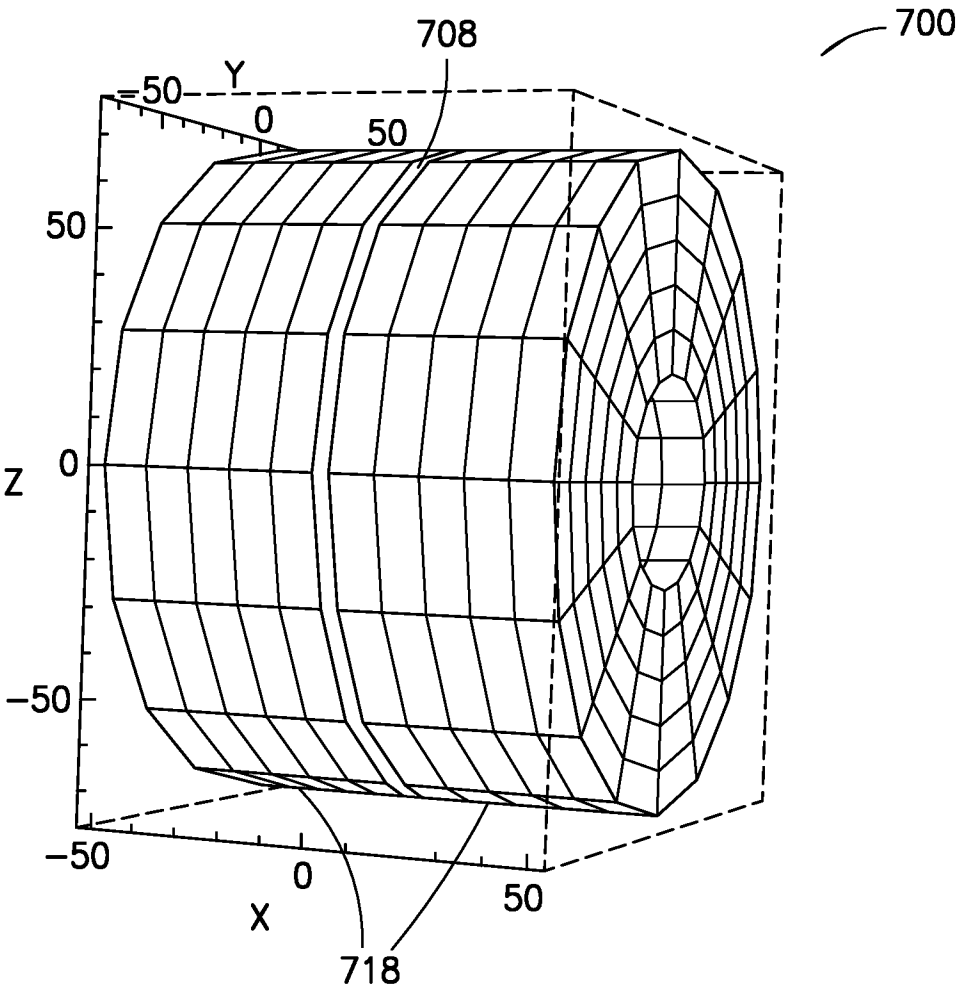
FIGS. 7*a*, 7*b* and 7*c* illustrate a toroidal Halbach magnet with a selected circumferential gap, and example field and delta field profiles for that magnet.
Figure 7B:
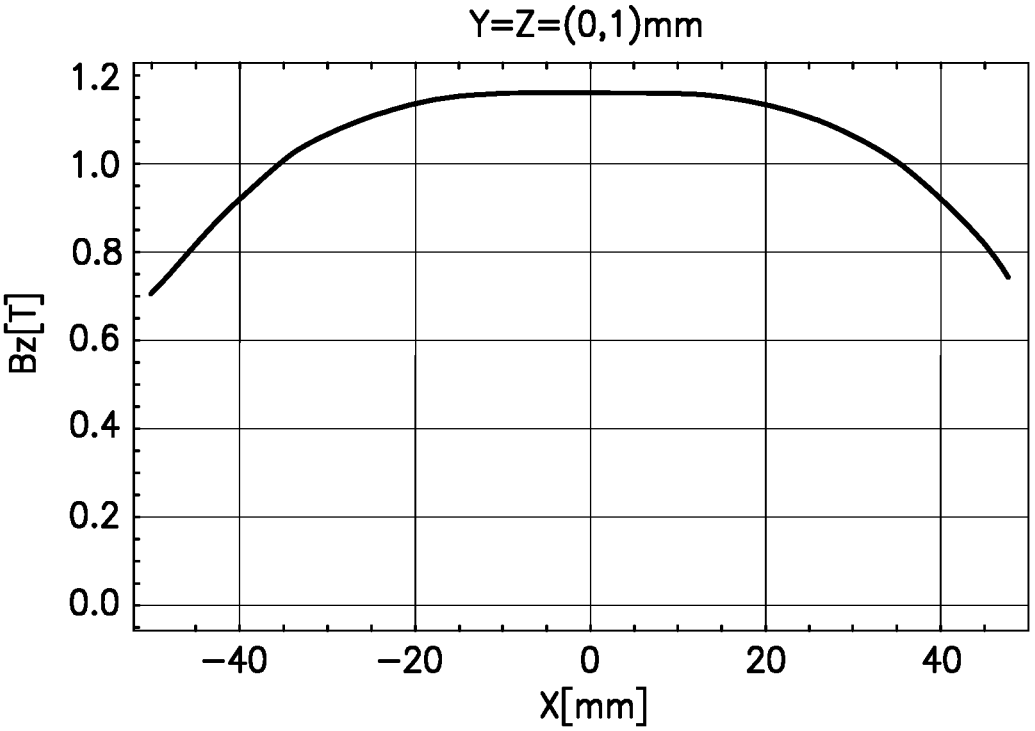
Figure 7C:
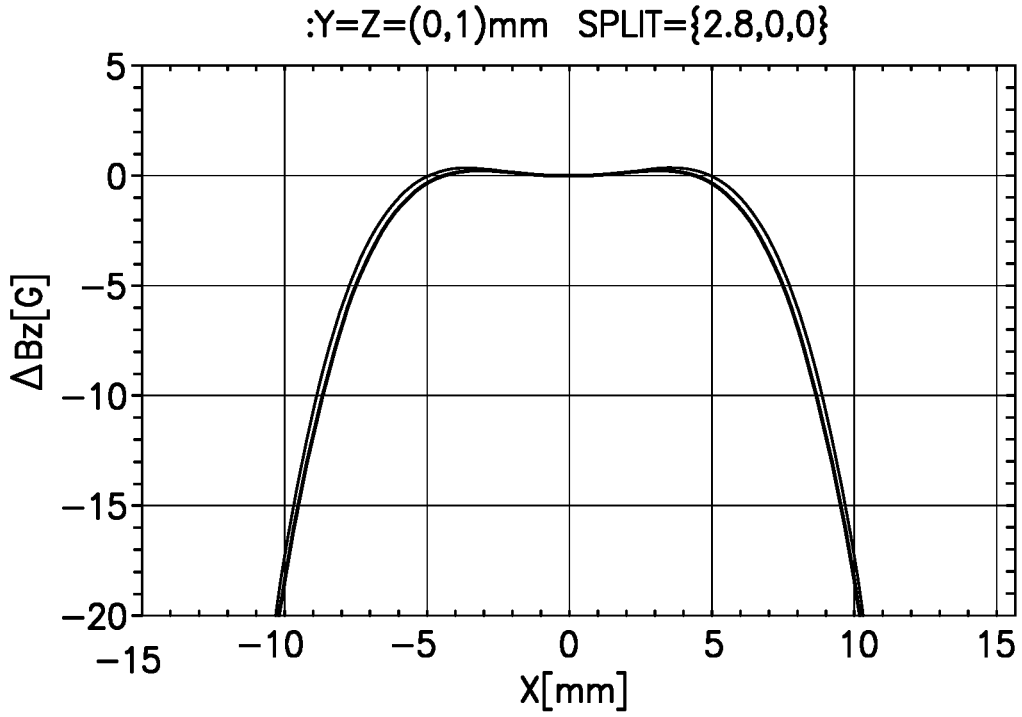

Turning to FIG. 7*a*, a magnet assembly 700 is illustrated that is in a Halbach arrangement of an annular shape, which is essentially identical to the magnet 600 of FIG. 6*a* except that a gap of 2.8 mm (about 0.11 inch) 708 is placed at the center of the magnet, thereby defining two cylindrical magnet elements 718. The magnetic field resulting from the magnet assembly 700 is seen in FIG. 7*b*, with the delta field seen in FIG. 7*c*. More particularly, the magnetic field Bz along the x axis (the axis of the central hole) resulting from the magnet 700 varies from approximately 0.7 Tesla to 1.15 Tesla (1 Tesla=$10^4$ Gauss). The field difference (delta field) from the center of the magnet is generally constant for at least 10 mm (5 mm on each side of the center), and only reaches 20 Gauss at about a distance of 10 mm from the center. A delta of 1 Gauss is obtained on about 6 mm on each side of the center. Comparing FIG. 7*c* with FIG. 6*c*, the "uniform" Bz field along the x-direction for the magnet assembly 700 is between ten and twelve times the length of the "uniform" Bz field of magnet 600.

While magnet assembly 700 of FIG. 7*a* includes two Halbach-type magnet elements 714 that are spaced by a gap of 2.8 mm, it will be appreciated that other gap sizes may be utilized in order to increase the uniformity of the resulting magnetic field.

In other embodiments, a magnet assembly 700 may include more than two Halbach-type magnet elements that are spaced apart by gaps in order to increase the uniformity of the resulting magnetic field. The gaps may be equal or non-equal in size. In one embodiment, the gaps are larger toward the middle of the assembly and decrease in size as they extend toward the ends of the magnet assembly.

Figure 8:
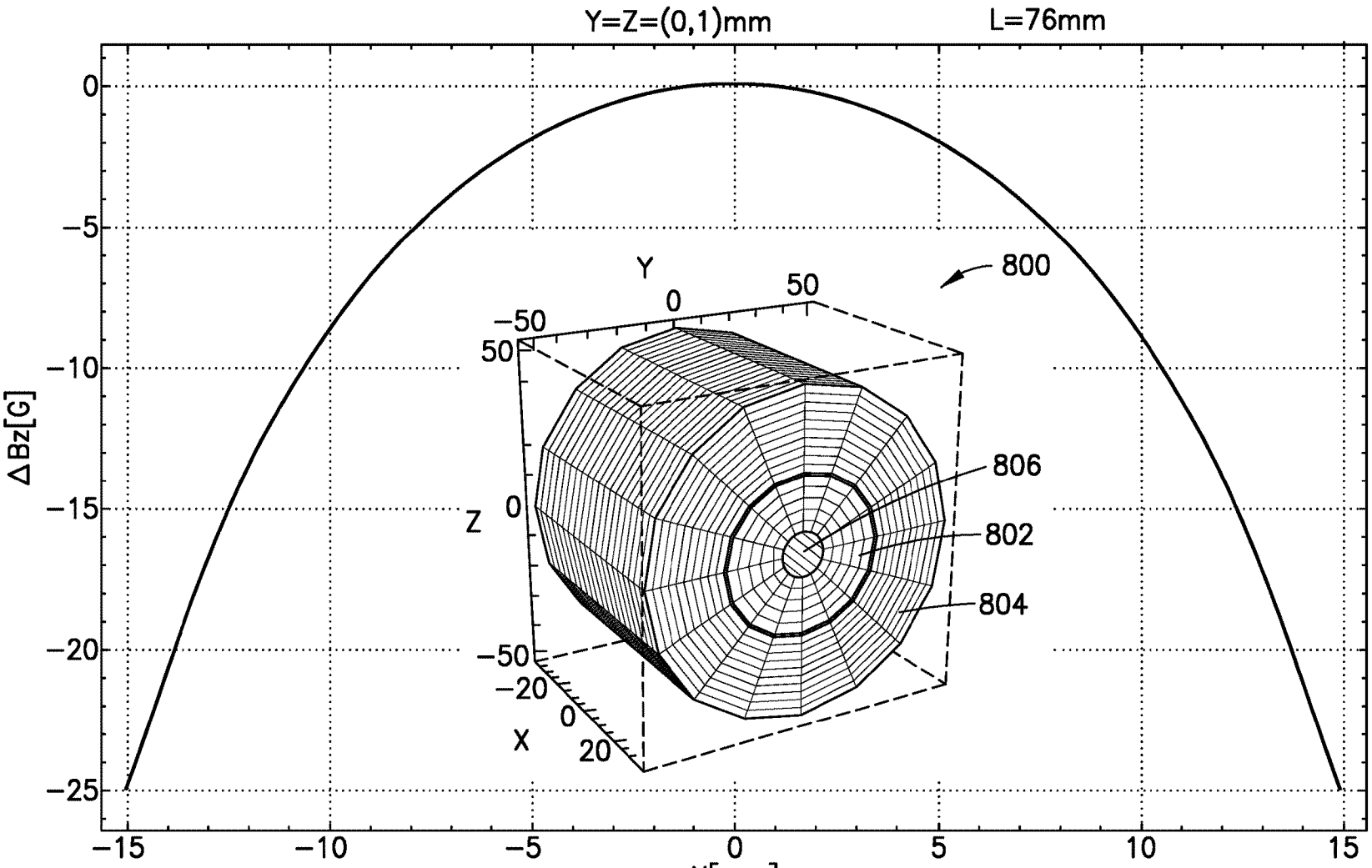
FIG.8 PRIOR ART
FIG. 8 illustrates a prior art shim-a-ring magnet assembly and a delta field profile for the assembly.

Prior art FIG. 8 illustrates a schematic diagram of another type of magnet described as a shim-a-ring magnet 800 that can be used in some implementations of magnet design. One possible implementation of a shim-a-ring magnet 800 is described in: Nath, P., et al. "The "Shim-a-ring" magnet: Configurable static magnetic fields using a ring magnet with a concentric ferromagnetic shim." Applied Physics Letters 102.20 (2013): 202409. As illustrated, the design of shim-a-rim magnet 800 can include a diametrically magnetized, hollow cylindrical permanent magnet 802 placed inside a concentric ferromagnetic cylinder 804. The ferromagnetic ring 804 is magnetized according to the magnetic field distribution of the cylindrical ring magnet 802, i.e., the ferromagnetic ring 804 is magnetized in a continuous polarization pattern similar to a Halbach design. As a result, the magnetic field inside the central cylindrical hole 806 of the ring magnet 802 becomes the superposition of the field generated by the ring magnet 802 and the magnetized ferromagnetic ring 804.

The delta field profile along the x-axis of the shim-a-ring magnet 800 having a length of approximately three inches, a magnet inner diameter of 0.5 inches, a magnet outer diameter of 2 inches and a ferromagnetic cylinder outer diameter of approximately 4 inches is also shown in FIG. 8. The delta field profile appears generally parabolic, and a delta of 1 Gauss is reached at about a distance of 4 mm from the center of the magnet (giving uniformity over about 8 mm). The delta increases to about 9 Gauss at about 10 mm from the center and to about 25 Gauss at a distance of 15 mm from the center.

Figure 9A:
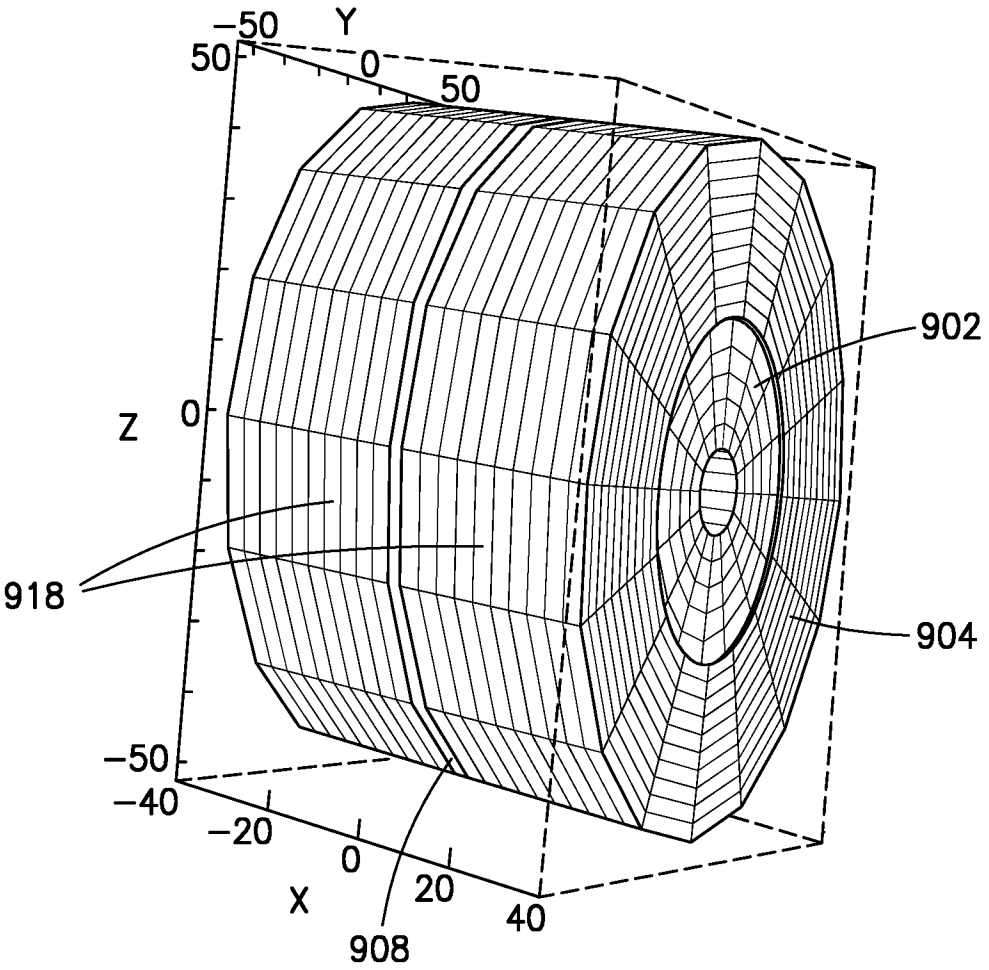
FIGS. 9*a* and 9*b*-9*e* illustrate a shim-a-ring magnet assembly having a designed circumferential gap in the shield, and the delta field profiles for assemblies of different designed gap widths in the shield.
Figure 9B:
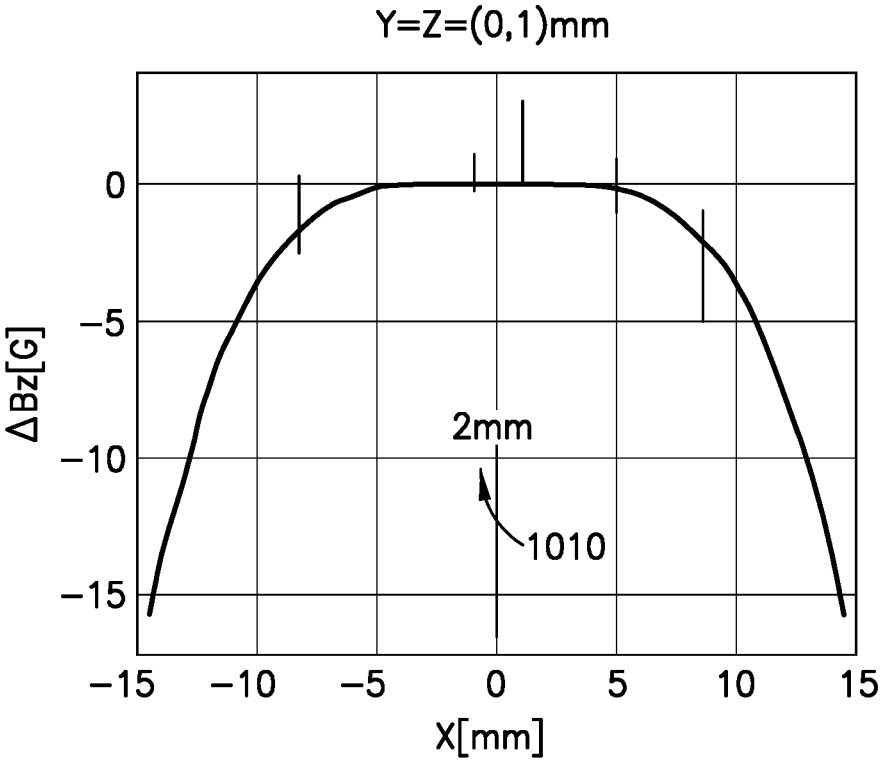
Figure 9C:
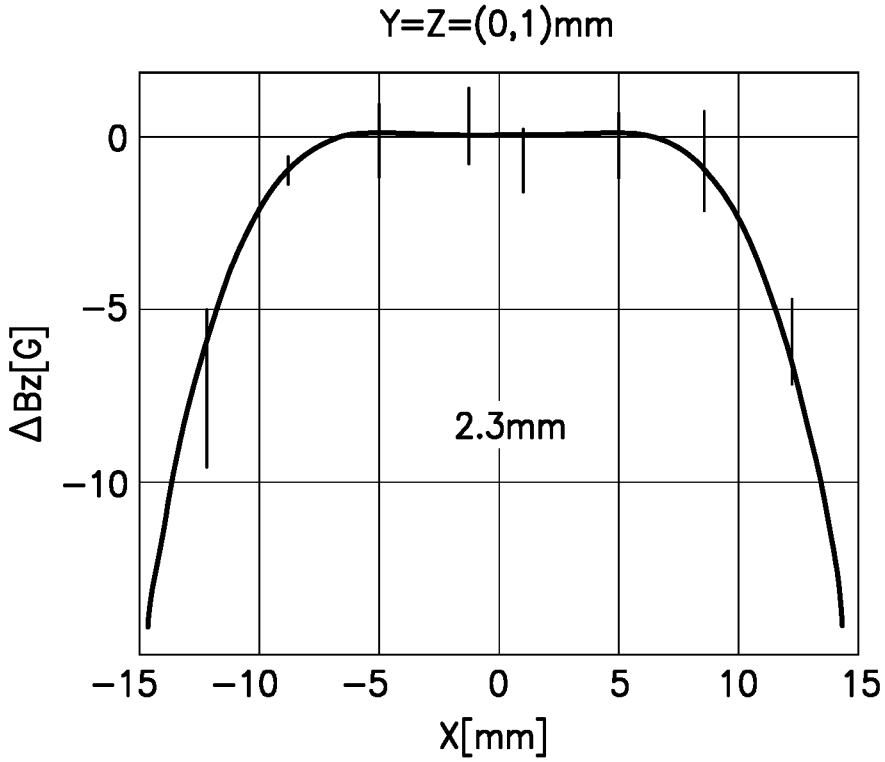
Figure 9D:
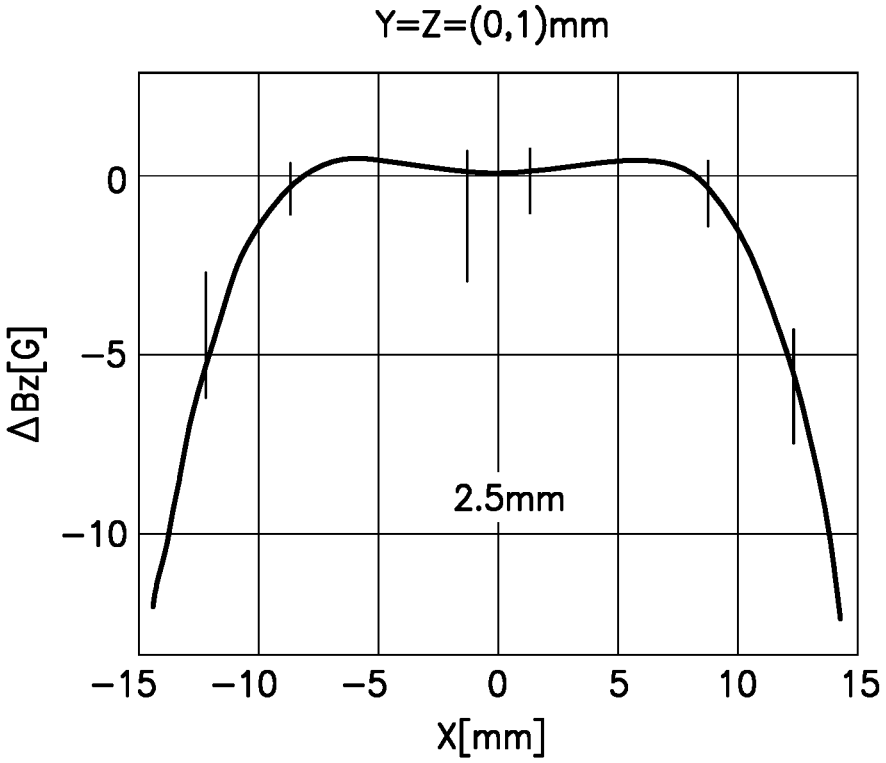
Figure 9E:
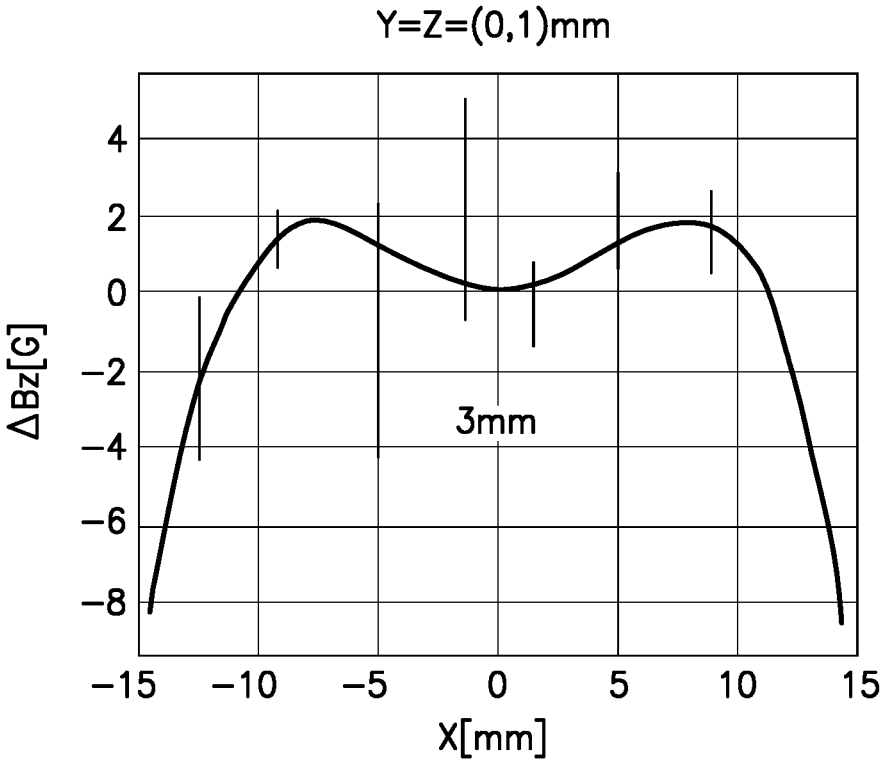

Turning to FIG. 9*a*, a shim-a-ring magnet 900 is shown with a hollow cylindrical permanent magnet 902 placed inside a concentric ferromagnetic cylinder or shield 904 which is split into two elements 914 separated by a gap 908. Other than the gap, the dimensions of the shim-a-ring magnet 900 is the same as the magnet 800. By controlling a width of the gap of the split in the ferromagnetic cylinder, the magnetic field profile may be adjusted, as shown in FIGS. 9*b*-9*e*, which illustrate field profiles along the x-axis 908 of the shim-a-ring magnet assembly. Thus, as seen in FIG. 9*b*, with a gap of 2 mm in the ferromagnetic cylinder, a uniform field is generated along about 14 mm (7 mm on each side of the center) of the x-axis of the magnet 900. With a gap of 2.3 mm, as seen in FIG. 9*c*, the uniform field extends about 17 mm along the x-axis of the magnet. With a gap of 2.5 mm, the uniform field extends along about 20 mm of the x-axis of the magnet as seen in FIG. 9*d*. However, as seen in FIG. 9*e*, if the gap is extended to 3 mm, the uniformity of the field decreases (relative to the field uniformity of the 2 mm, 2.3 mm and 2.5 mm gaps) to about 10 mm along the x-axis of the magnet.

Figure 10:
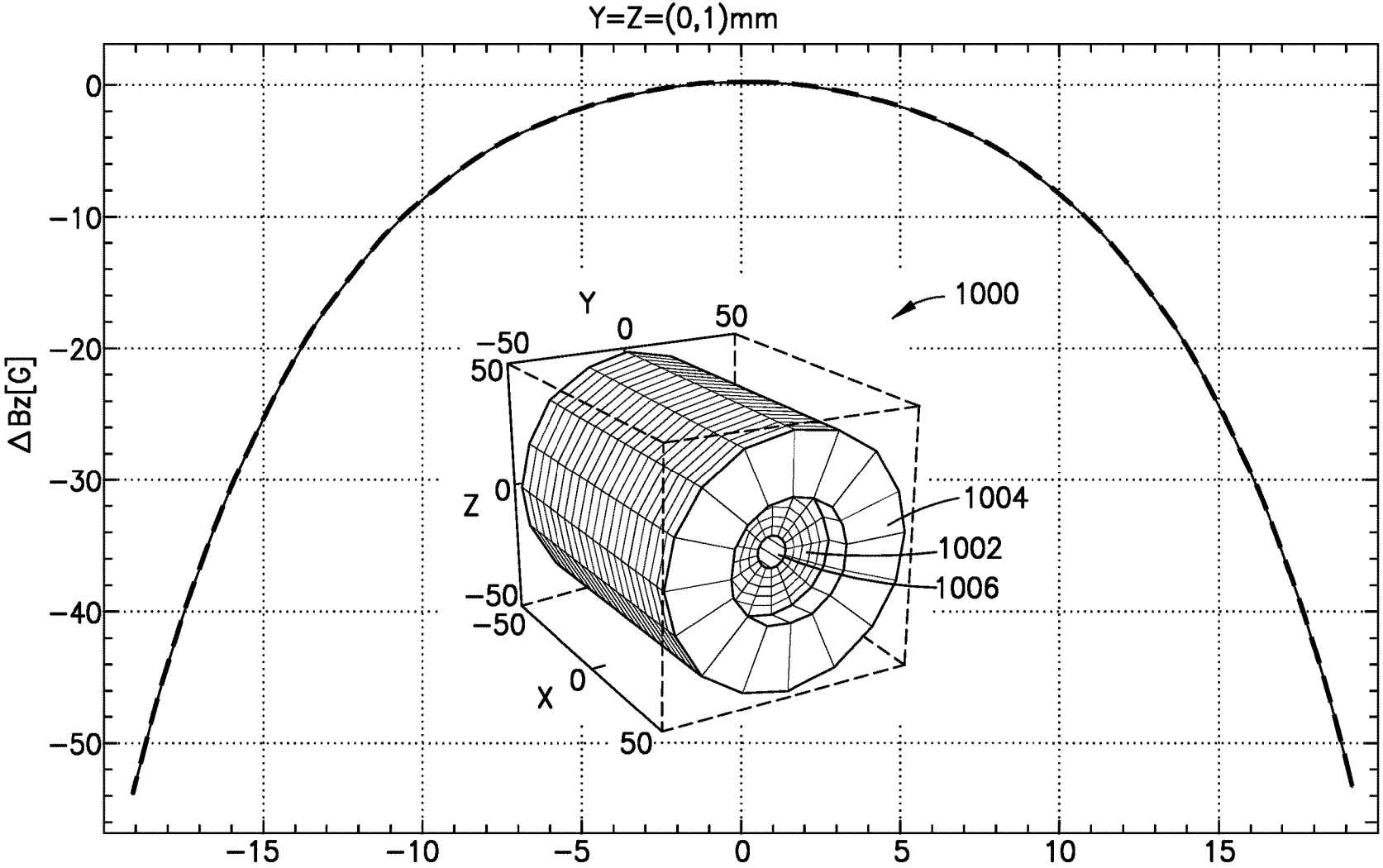
FIG.10 PRIOR ART
FIG. 10 illustrates a prior art shim-a-ring magnet assembly with no gaps and the delta field for the same.

Prior art FIG. 10 illustrates another shim-a-ring magnet assembly 1000 having a toroidal inner magnet 1002 defining a cylindrical space or hole 1006, and a ferromagnetic cylinder 1004 which extends radially around and, in this case, axially beyond the magnet. The delta magnetic field profile for the assembly 1000 is also shown in FIG. 10. The delta magnetic field profile is generally parabolic with generally uniform field having a delta Bz of 1 Gauss or less extending about 8 mm along the x-axis (4 mm on each side of the middle).

Figure 11:
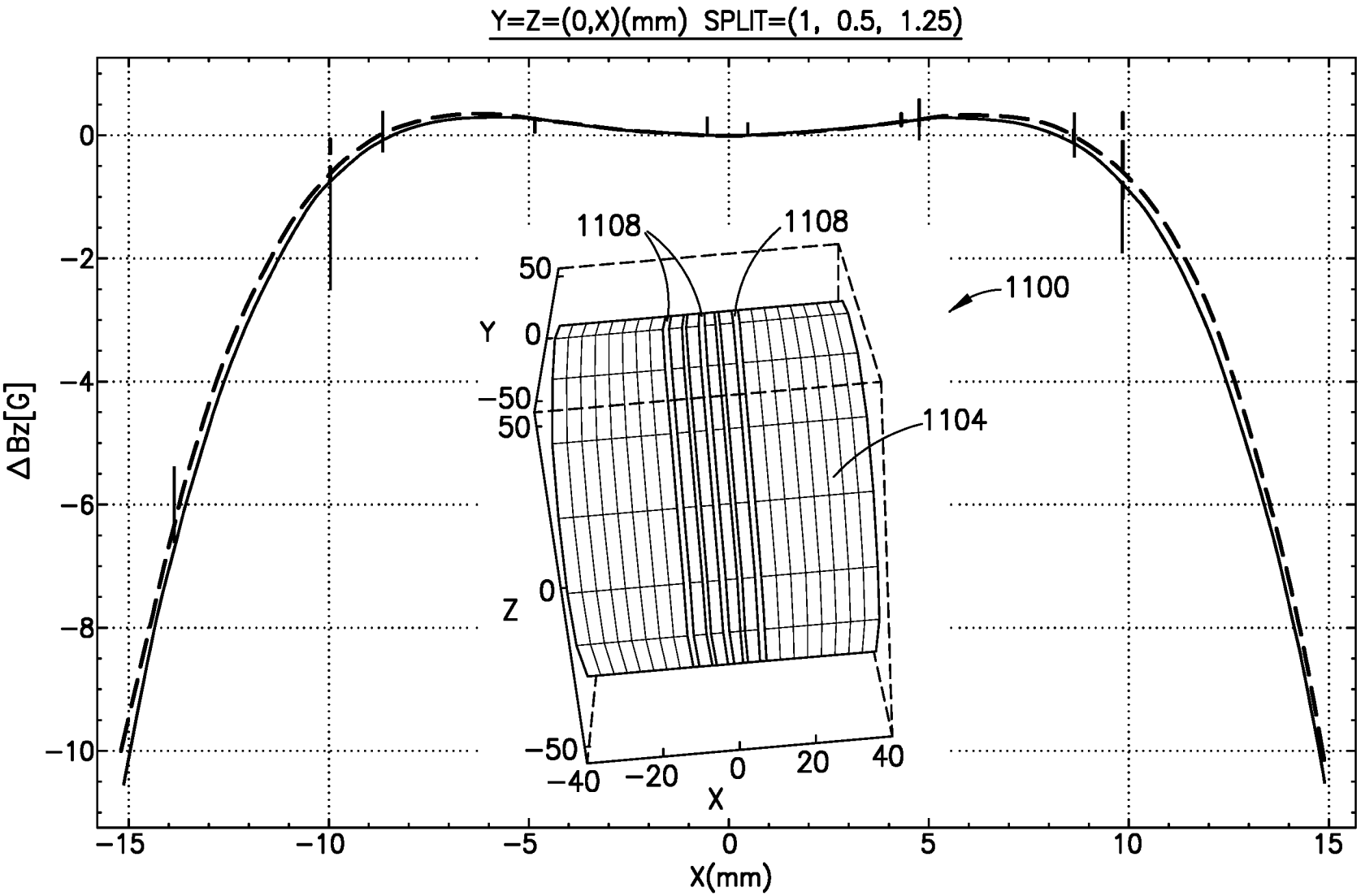
FIG. 11 illustrates the shim-a-ring magnet assembly of FIG. 10 but with circumferential gaps in the ferromagnetic shield and the delta field for the same.

When the same shim-a-ring assembly 1000 of prior art FIG. 10 is provided with multiple gaps in the ferromagnetic cylinder, the delta magnetic field profile is significantly improved. More particularly, as seen in FIG. 11, assembly 1100 is shown with a toroidal inner magnet defining a cylindrical space or hole, and a ferromagnetic cylinder 1104 that is provided with five gaps 1108, including a central gap of 1 mm, two gaps of 0.5 mm on either side of the center gap, and two gaps of 1.25 mm further away from the center. The delta magnetic field profile is also seen in FIG. 11 and has a generally uniform field having a delta Bz of 1 Gauss or less extending about 20 mm along the x-axis (10 mm on each side of the middle). Thus, the resulting magnetic field shows a uniformity of about 2.5 times the distance relative to the non-split arrangement of FIG. 10.

It will be understood that any number of gaps 1108, with any types of sizing, can be included in the shim-a-rim magnet assembly 1100 with uniform and/or non-uniform spacing in order to influence the field profile as desired. In one aspect, the number, location, and/or size of gaps 1108 can be modeled using software capable of simulating magnetic field distribution to isolate configuration(s) of gaps 1108 resulting in a desired field profile with magnetic homogeneity above a given desired threshold for a desired distance.

According to another aspect, radial gaps may be provided in the ferromagnetic cylinder in order to impact the magnetic field profile of a magnet assembly. These radial gaps may be in addition to circumferential gaps, or may be provided even where circumferential gaps are not provided. These gaps are provided by carving material from the ferromagnetic cylinder. Thus, as described hereinafter, after a shim-a-ring magnet assembly is manufactured, the magnetic field generated by the magnet assembly may be tested, and based on the pattern of the non-uniformity of the magnet assembly, radial gaps may be carved into the ferromagnetic cylinder in order to increase the uniformity of the magnetic field of the magnet assembly.

Figure 12A:
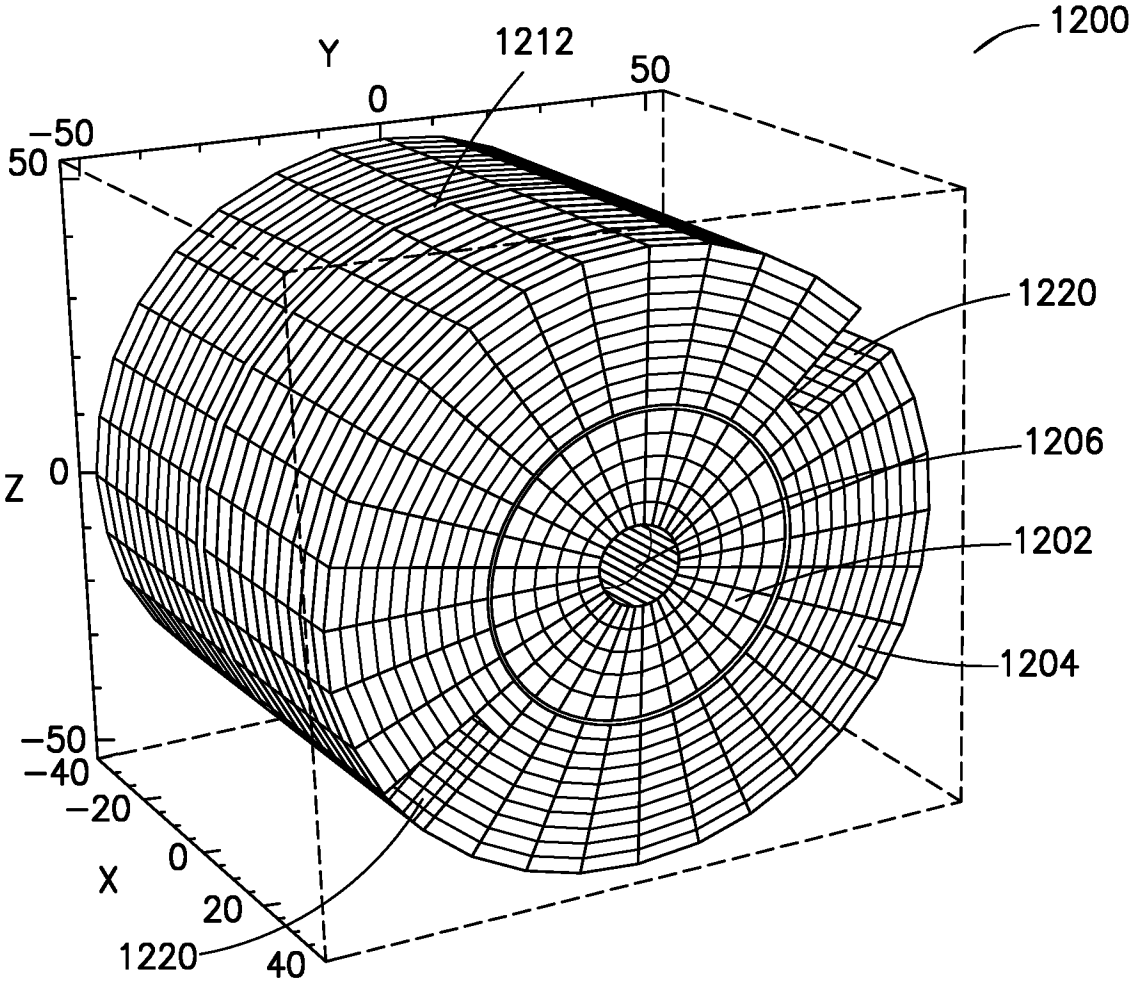
FIGS. 12*a*, 12*b* and 12*c* illustrate a shim-a-ring magnet assembly with a circumferential and a plurality of designed radial gaps or slots in the shield, and the resulting delta fields along different axes for the same design.
Figure 12B:
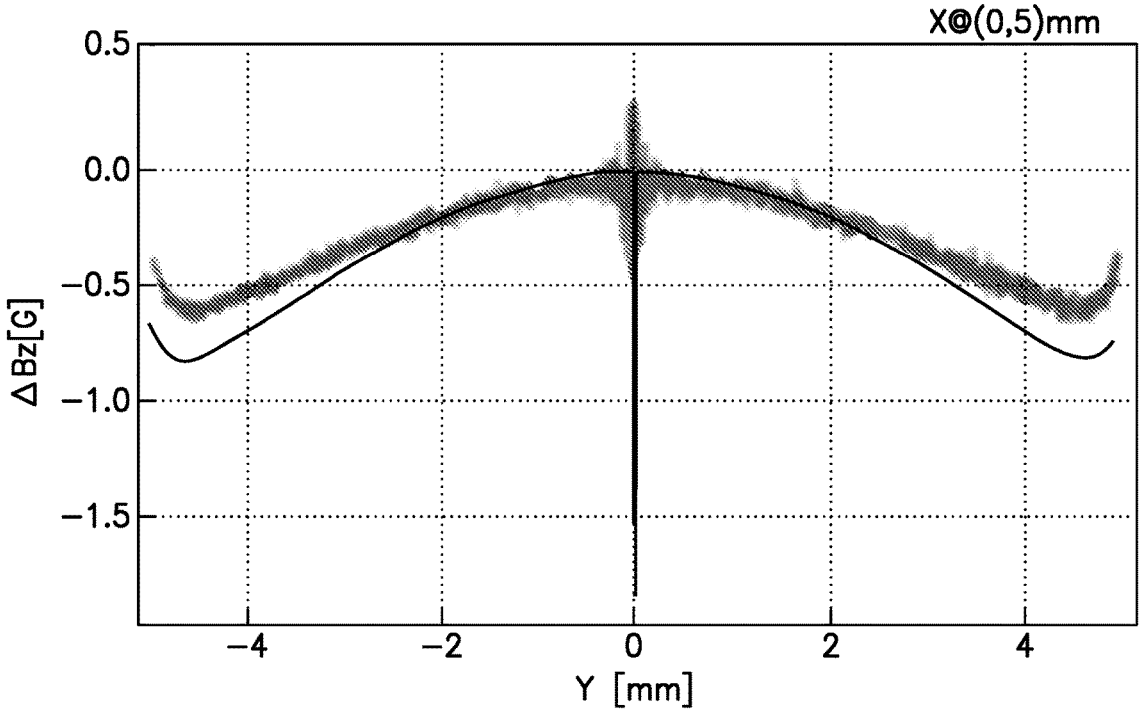
Figure 12C:
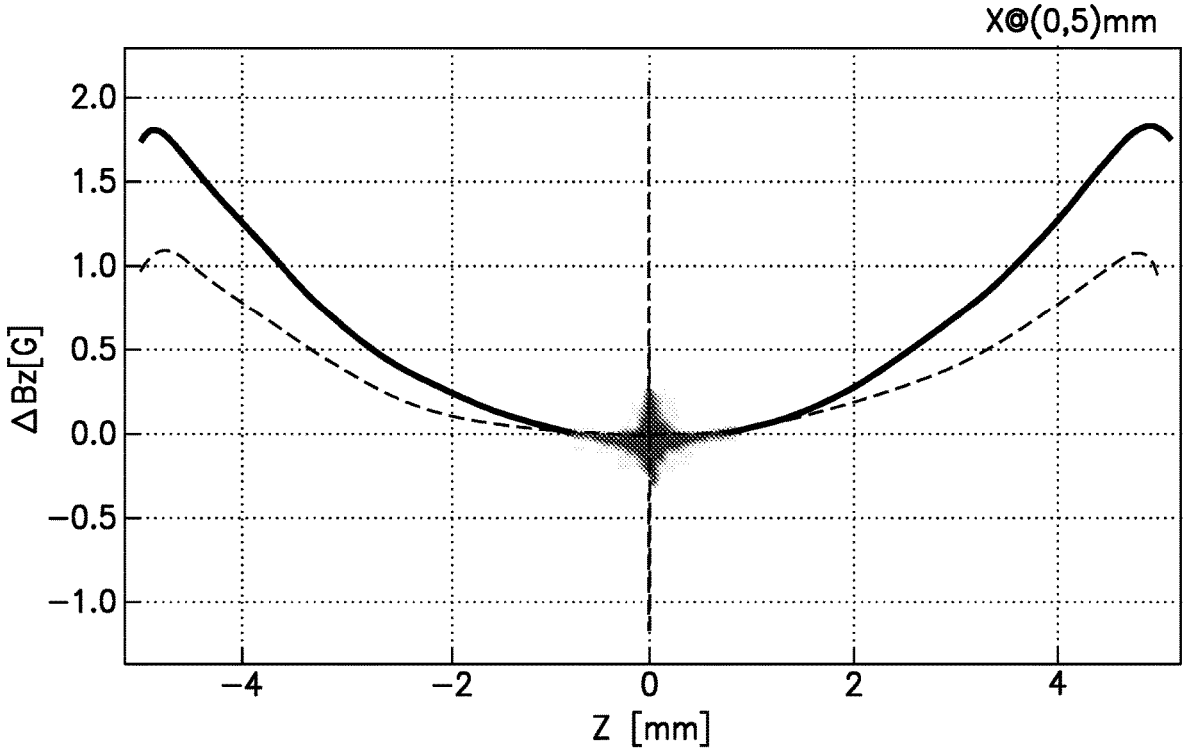

Turning to FIG. 12*a*, a shim-a-ring magnet assembly 1200 is seen with a toroidal Halbach ring magnet 1202 defining an open inner cylinder 1206, and a ferromagnetic outer cylinder 1204 surrounding the magnet 1202. A circumferential groove or gap 1212 is seen at the middle of the ferromagnetic cylinder 1204, and two radial grooves or gaps 1220 of approximately ten degrees each are seen offset 180 degrees from each other and extending at least partially into the cylinder. As shown in FIG. 12*a*, the grooves are substantially trapezoidal in shape (with one rounded end), and extend about 70% of the way into the ferromagnetic cylinder. The delta magnetic field profile along the y and z axes for the magnet assembly 1200 are seen in FIGS. 12*b* and 12*c* taken at two different x value locations (0 mm and 5 mm). As will be appreciated, because of the use of two radial grooves 1220 that are symmetrical, the delta magnetic field profiles are generally symmetrical.

It will be appreciated that any number of radial and/or circumferential gaps or grooves having desired shapes, sizes, orientations, locations, etc., can be added, carved in the ferromagnetic ring of a magnet to alter the magnet's properties and produce a desired field profile.

In some embodiments, the gaps or grooves may be introduced in order to overcome non-uniformities due to slight anisotropies in the material, e.g. in the ferromagnetic ring. In other embodiments said gaps or grooves may be filled with material with different ferromagnetic properties than the rest of the ferromagnetic shield.

Figure 13A:
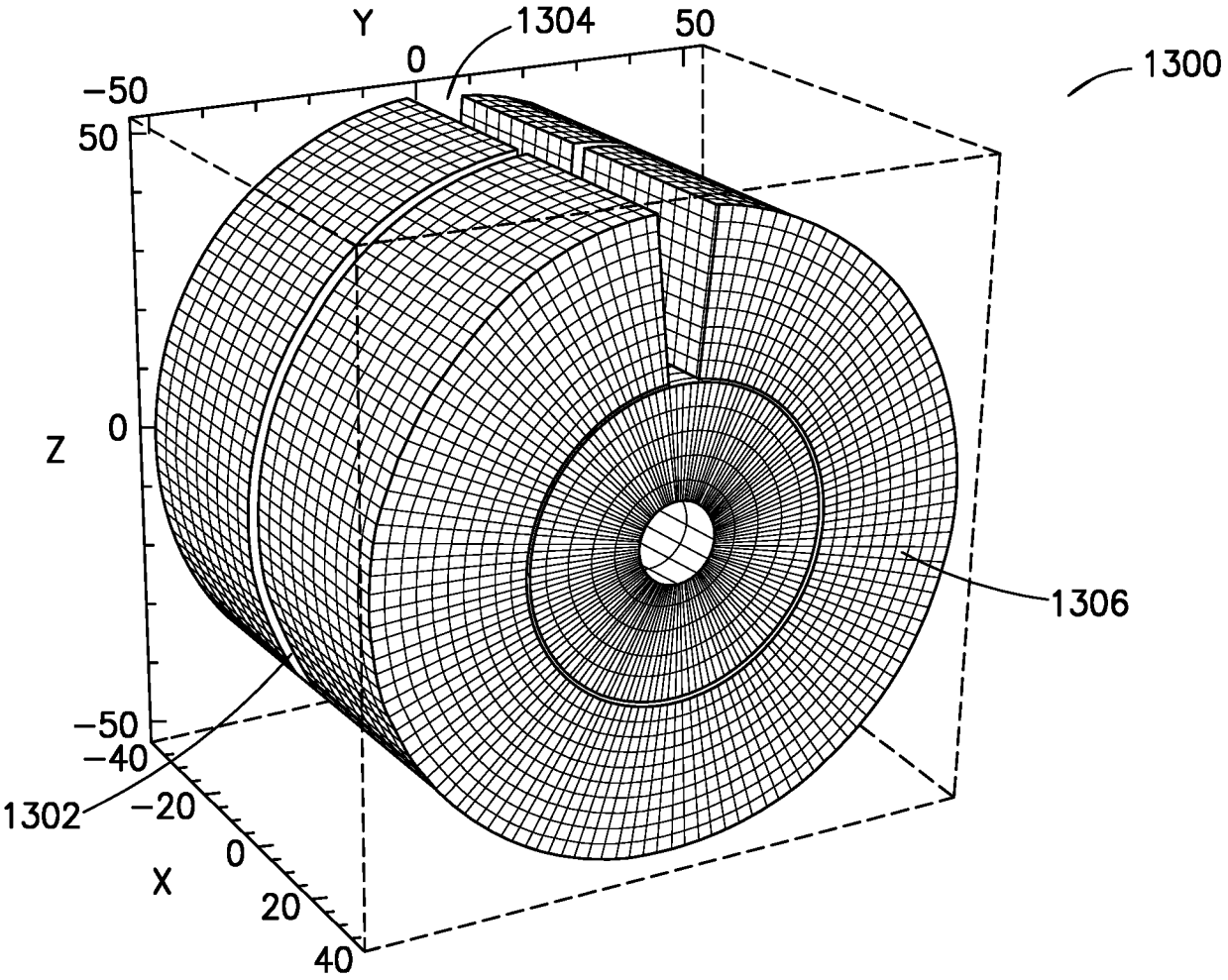
FIGS. 13*a*, 13*b* and 13*c* illustrate a shim-a-ring magnet assembly with a circumferential and a single designed radial gap in a first location, and the resulting delta field profiles for the same design.
Figure 13B:
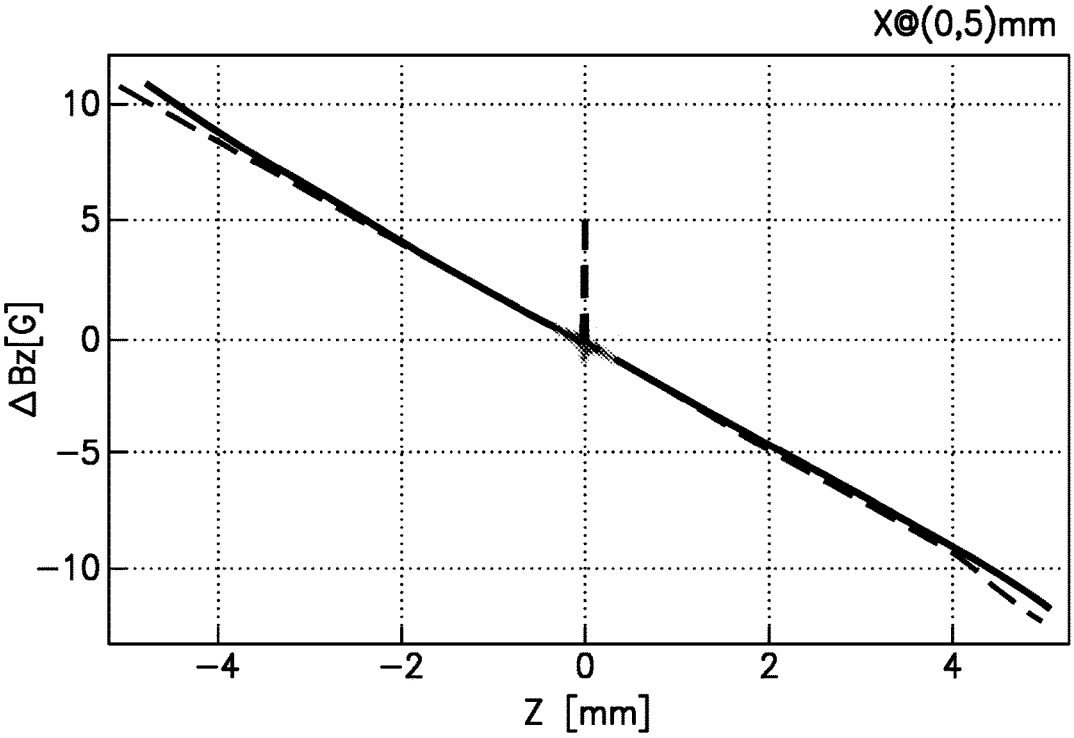
Figure 13C:
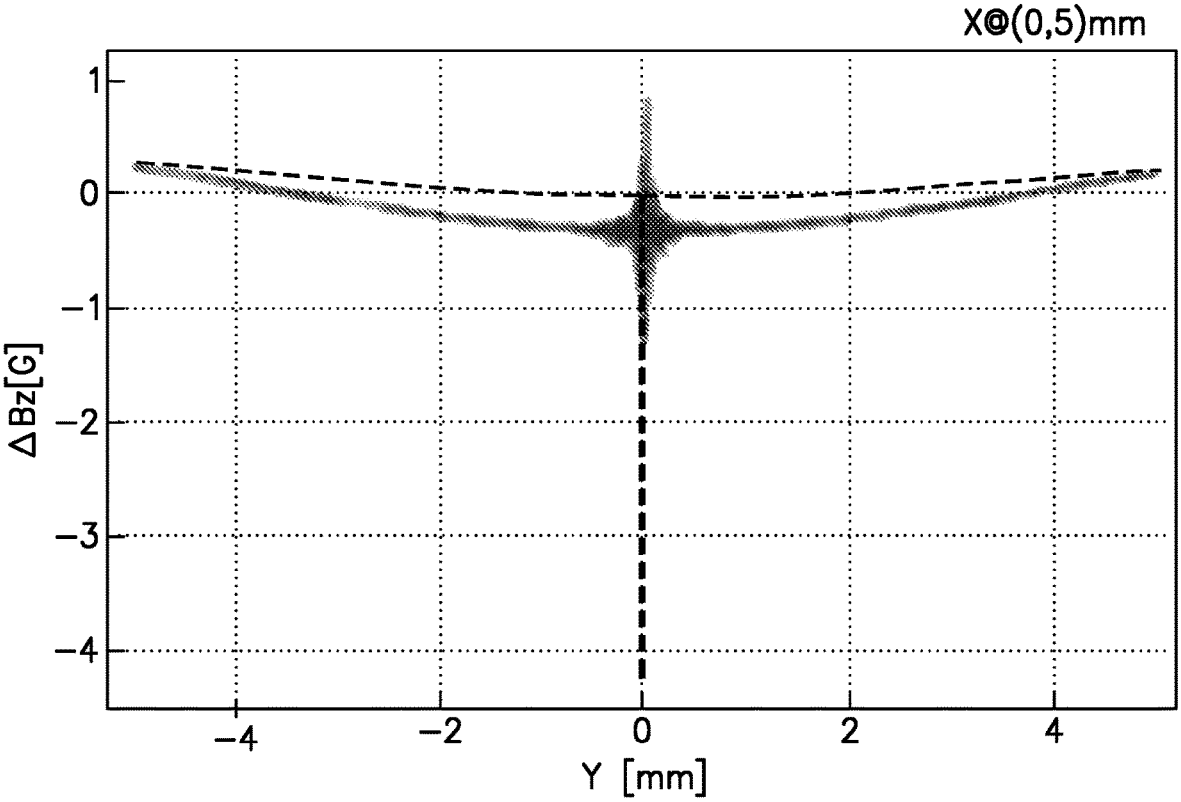

For example, FIG. 13*a* illustrates a shim-a-ring magnet 1300 with a circumferential approximately 2 mm gap 1302 running through the entire thickness of the ferromagnetic ring 1306 at the middle of the ring, and a slot (groove) 1304 of about ten degrees located at the top of the ring 1306 and running through the entire thickness and length of ferromagnetic ring 1306. The gap 1302 and slot 1304 configuration in FIG. 13*a* results in delta field profiles seen in FIGS. 13*b* and 13*c* along the z axis and along the axis. While the y axis delta profile is symmetrical, the z axis delta profile is not.

Figure 14A:
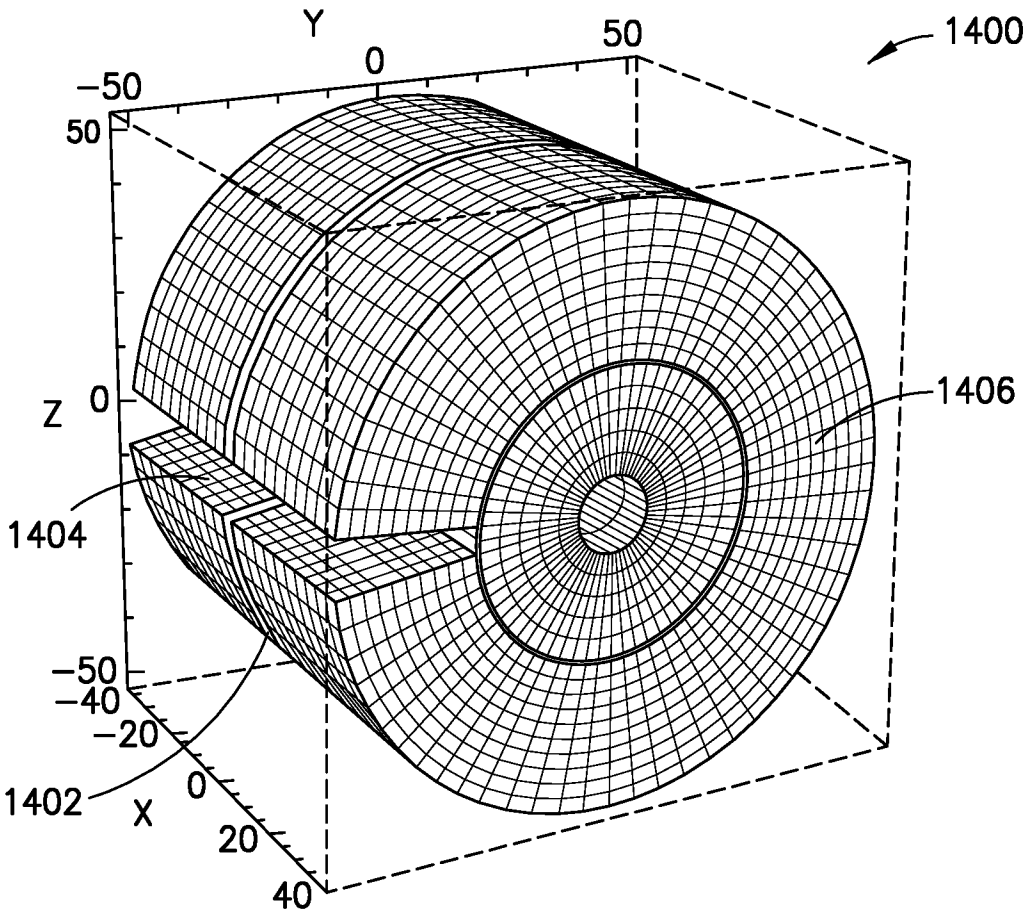
FIGS. 14*a*, 14*b* and 14*c* illustrate a shim-a-ring magnet assembly with a circumferential and a single designed radial gap in a second location, and the resulting delta field profiles for the same design.
Figure 14B:
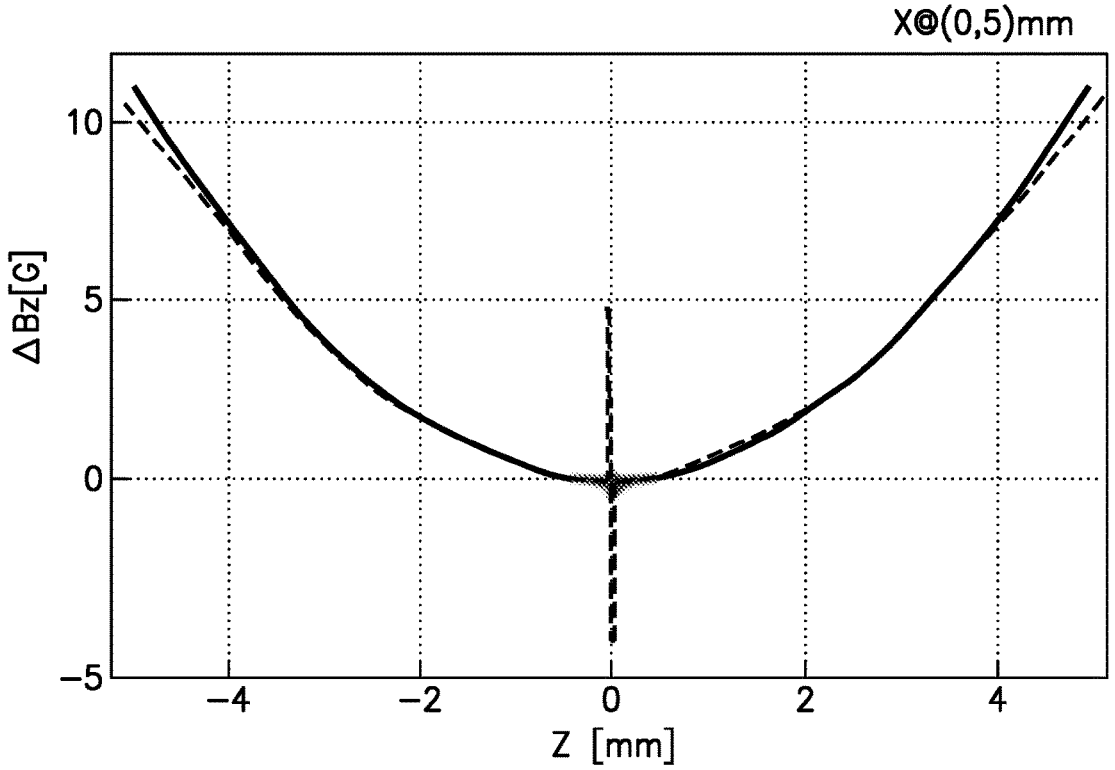
Figure 14C:
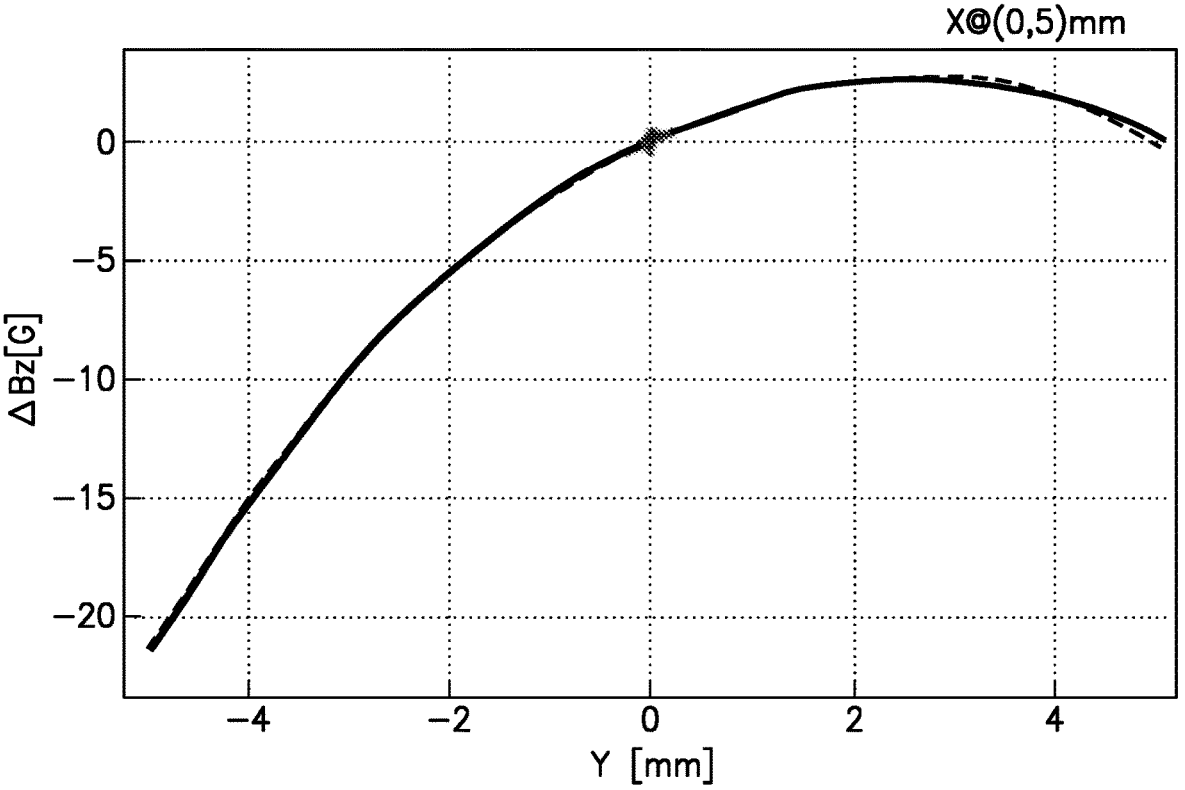

FIG. 14*a* illustrates another example magnet 1400 with a circumferential gap 1402 and a slot 1404 in a ferromagnetic ring 1406. The size and location of gap 1402 is the same as in the shim-a-ring magnet 1300 of FIG. 13*a*, and the size of the slot 1404 is likewise the same as in FIG. 13*a*, except that it is rotated ninety degrees. The resulting delta field profiles along the z axis and y axis are seen in FIGS. 14*b* and 14*c*. Here, while the z axis delta profile is symmetrical, the y axis delta profile is not.

Figure 15A:
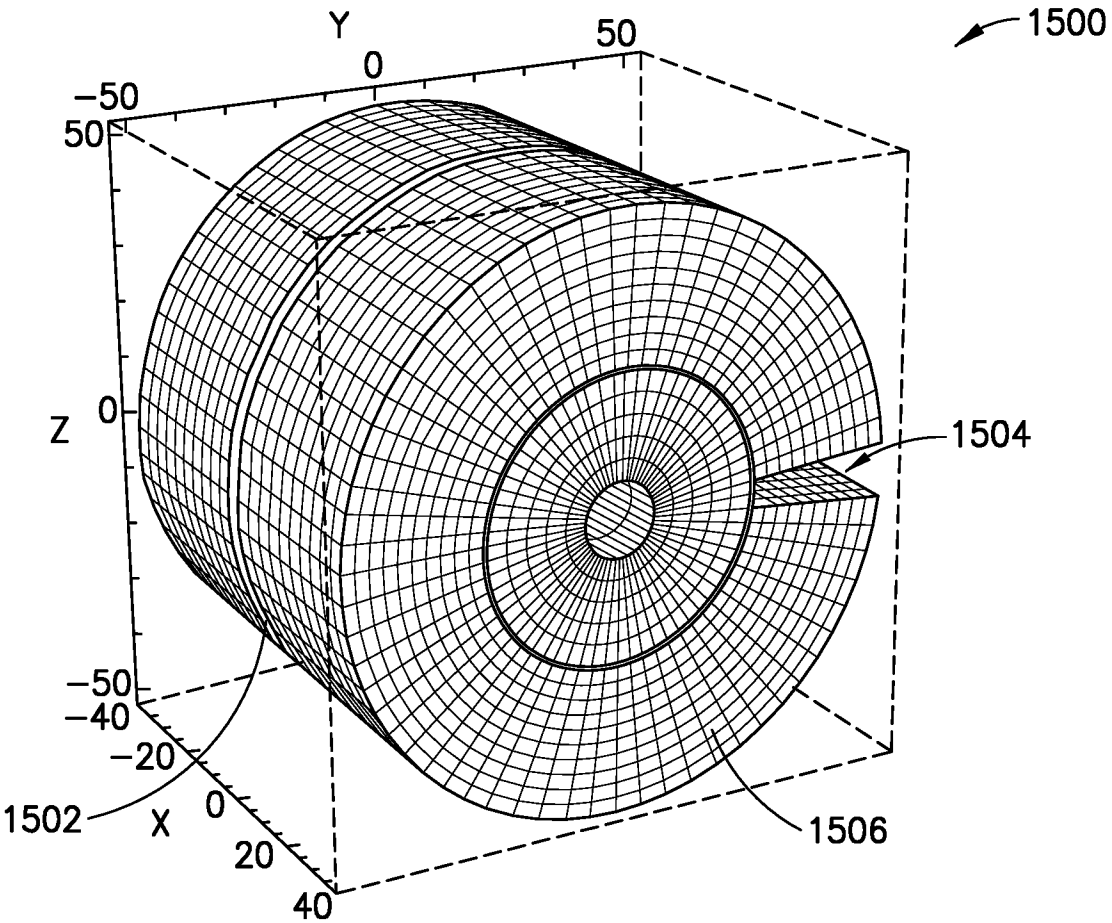
FIGS. 15*a*, 15*b* and 15*c* illustrate a shim-a-ring magnet assembly with a circumferential and a single designed radial gap in a third location, and the resulting delta field profiles for the same design.
Figure 15B:
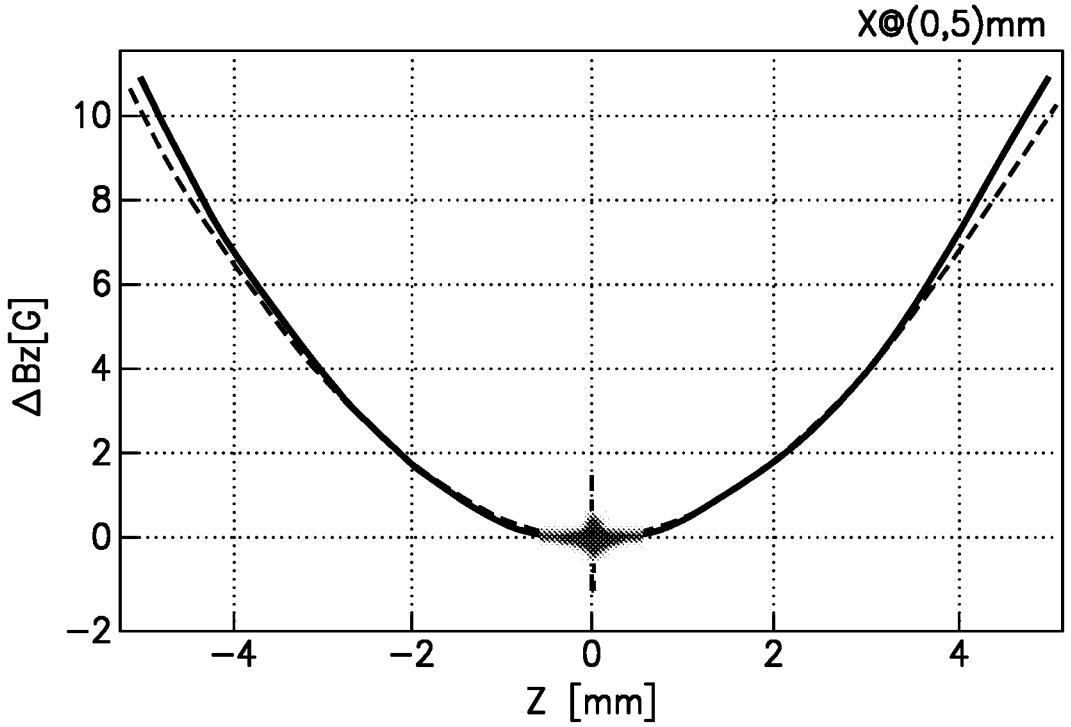
Figure 15C:
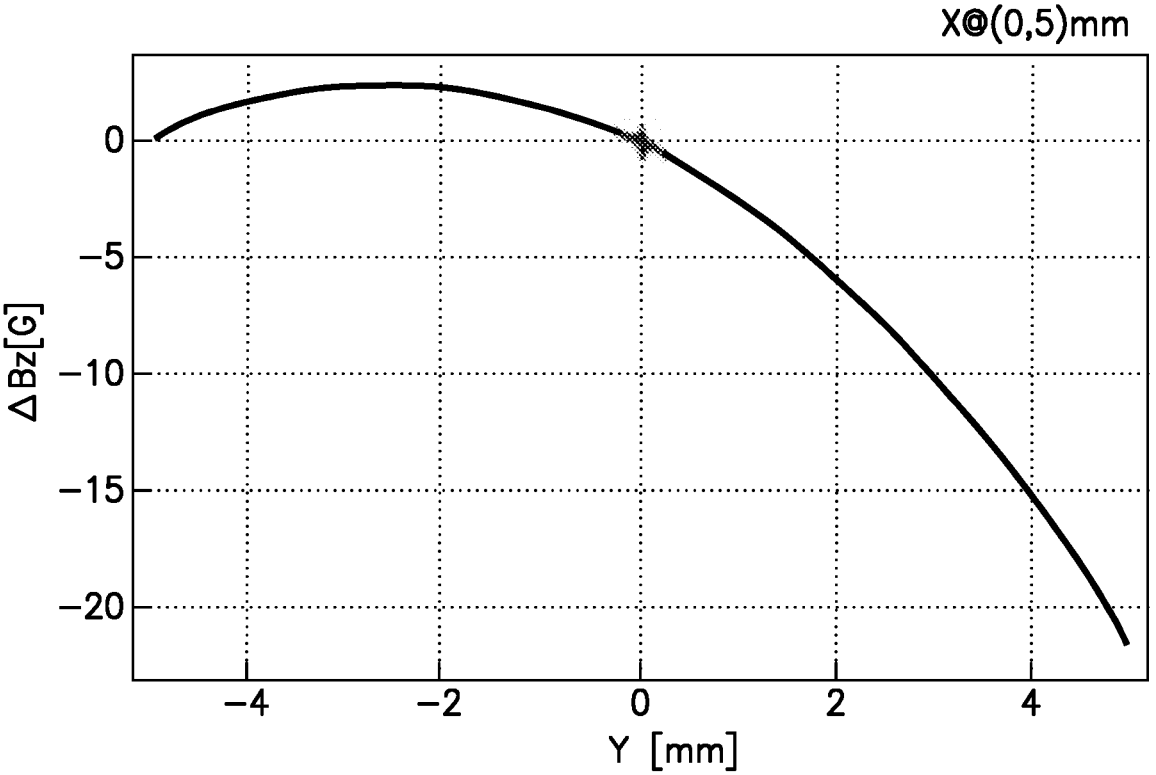

FIG. 15*a* illustrates yet another example magnet 1500 with a circumferential gap 1502 and a radial slot 1504 in a ferromagnetic ring 1506. Again, the gap 1502 and slot 1504 configuration in magnet 1500 are substantially the same as the gap and slot configuration in magnets 1300 and 1400 except for the radial location of the slot 1504. The resulting delta field profiles along the z axis and along they axis are seen in FIGS. 15*b* and 15*c* and reveal a symmetric delta profile along the z axis and an asymmetric profile along the y axis.

Figure 16A:
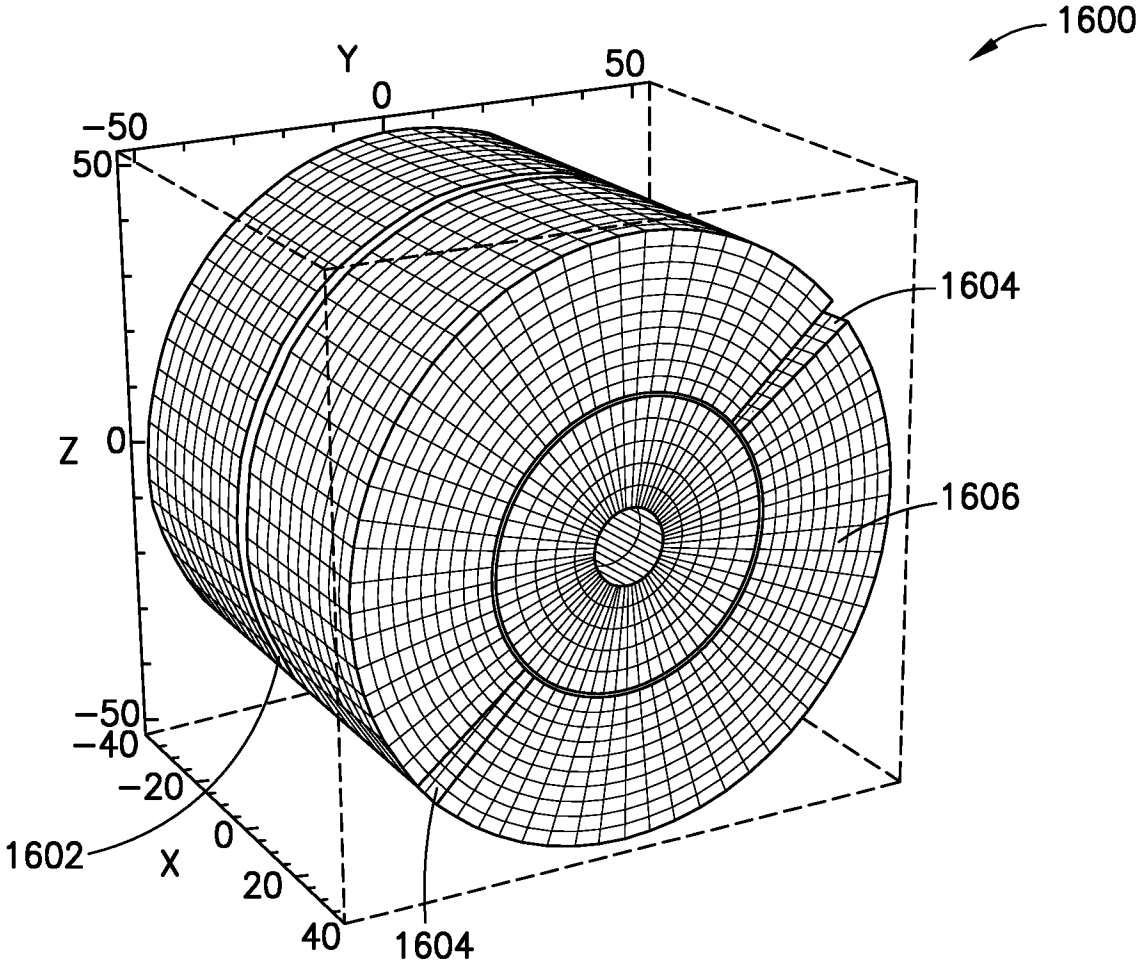
FIGS. 16*a*, 16*b* and 16*c* illustrate a shim-a-ring magnet assembly with a circumferential and a plurality of designed radial gaps or slots in the shield, and the resulting delta fields along different axes for the same design.
Figure 16B:
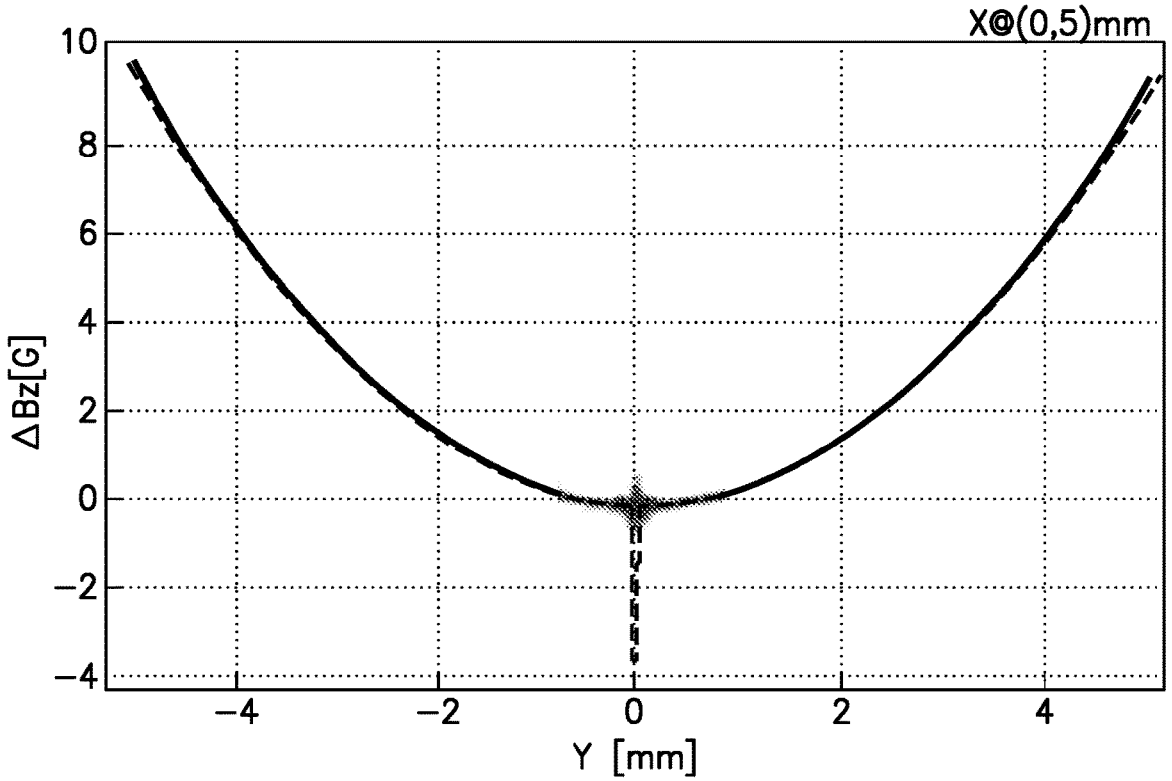
Figure 16C:
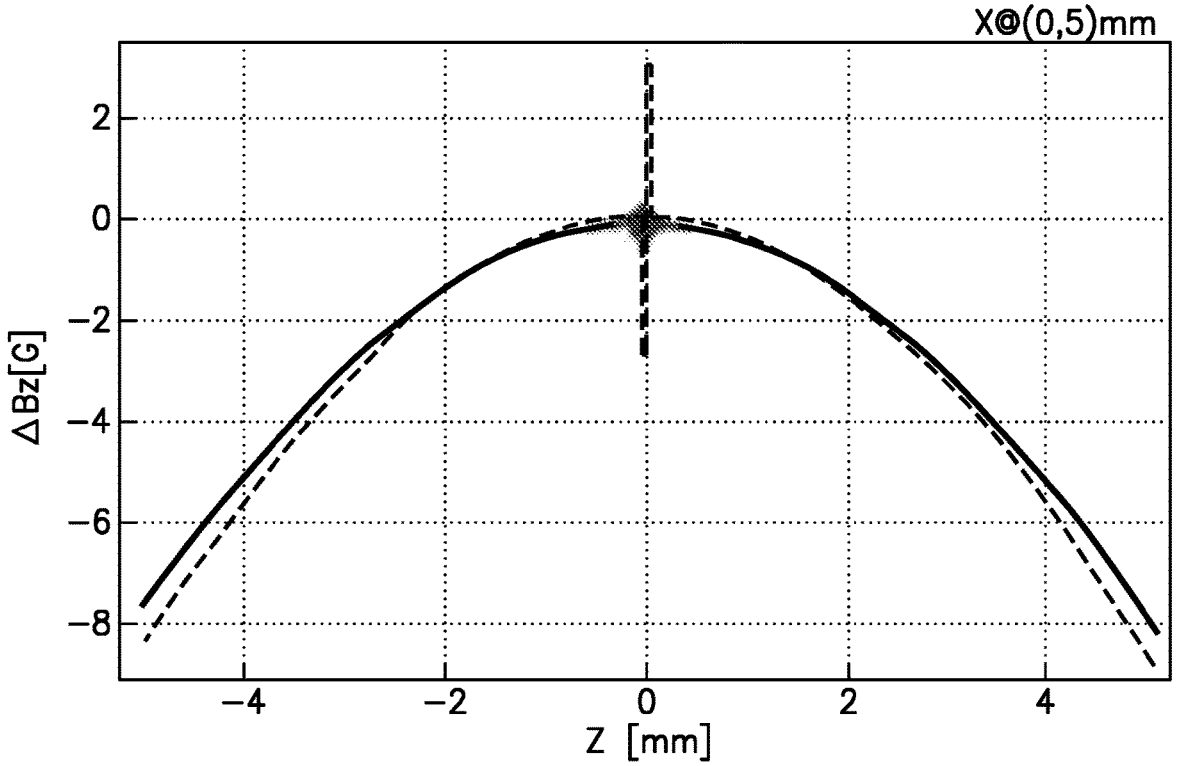

FIG. 16*a* illustrates still another example magnet 1600 with a circumferential gap 1602 and two radial slots 1604 in a ferromagnetic ring 1606. The gap 1602 and slot 1604 configuration in magnet 1600 is substantially the same as the gap and slot configuration in magnet 1200 except the slots run entirely through the radial thickness of the ring 1606 and are narrower (about five degrees each) than slots 1204 of the ring 1206. The gap 1602 and slots 1604 configuration in magnet 1600 results in delta field profile along the y axis and along the z axis as seen in FIGS. 16*b* and 16*c* and reveal a symmetric delta profile along both the z axis and they axis.

According to one aspect, a shim-a-ring type magnet assembly is designed to provide a desirable magnetic field. However, upon manufacture, it is possible that the magnetic field generated by the manufactured magnet assembly is not as uniform as desired due to the inherent non-uniformity of the magnetic material utilized. Thus, in one embodiment, given the understanding previously provided of the magnetic fields generated when a ferromagnetic ring around a toroidal magnet is provided with slots, the manufactured magnet assembly is altered by carving one or more slots at one or more desired locations into the ferromagnetic ring in order to increase the uniformity of the magnetic field. More particularly, based upon the measured magnetic field of the manufactured magnet assembly, location(s), depth(s), and width(s) of the slots are chosen and carved in order to increase the uniformity of the magnetic field. In one embodiment, the carving may be done iteratively, i.e., a little at a time, and the magnet assembly magnetic field may be measured after each carving to determine whether additional material should be removed.

In one aspect, modeling software may be utilized to assist in selecting the location, depth, and width of the slots. By way of example only, software from ESRF, see, e.g., Radia, (European Synchrotron Radiation Facility), may be used/modified to permit definition of the shape, size and location of magnet pieces and shield materials in order to calculate the magnetic field in space. Thus, upon receiving a magnet assembly, the magnetic field along various axes may be determined. If the detected magnetic field results do not comply with what was expected or desired, the results may be inversely used in the model to determine the magnetism of the various elements of the magnet assembly. Then, a corrective slot or slots may be modeled in the software until a location(s), depth(s), and width(s) that provides the most uniform result is obtained. The ferromagnetic ring is then carved with one or more slots accordingly.

Figure 17:
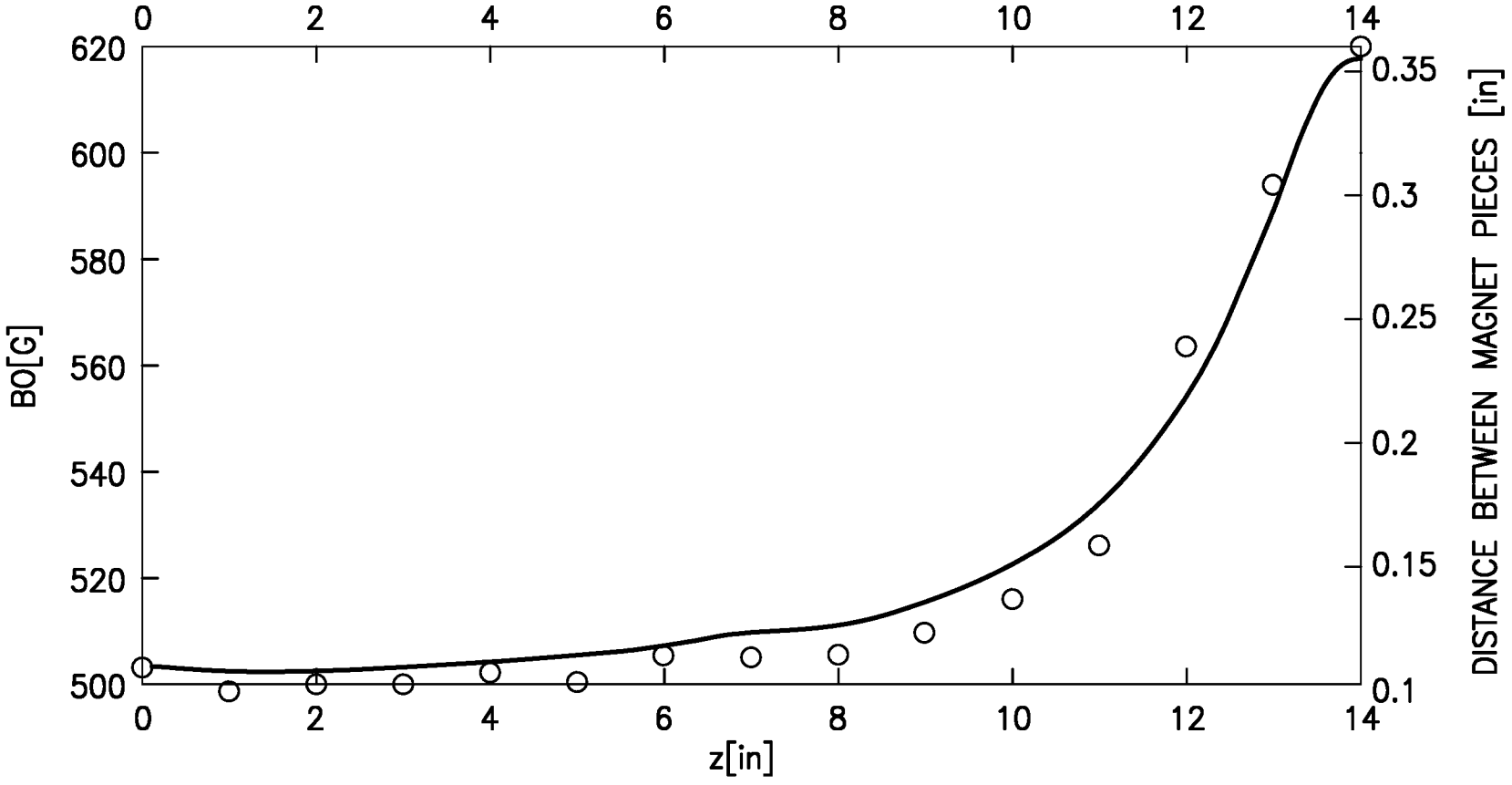
FIG. 17 illustrates an example magnetic field curve of a magnet assembly and optimal gap distances between segments of that assembly for generating a resulting desired uniform field in accordance with implementations of magnet design.

According to other embodiments, the magnetic field of a linear magnet assembly may likewise be optimized by first measuring the magnetic field generated by the magnet assembly without gaps between magnetic elements and then spacing the magnetic elements based on the detected field in order to produce a more uniform field. The spacing may be conducted algorithmically, or through use of a computer program (e.g., modeling), or based on knowledge and trial and error. By way of example, the magnetic field was measured of a magnet assembly such as shown in FIG. 2*a* with thirty identical magnets. The field is shown in FIG. 17 as a function of the distance away from a center point of the z axis and ranges from about 500 Gauss to 620 Gauss. In one embodiment, utilizing software that may be used/modified to permit definition of the size, shape and location of magnet pieces in order to calculate the magnetic field, gaps of different sizes ranging from 0.1 mm to 0.35 mm between the magnetic pieces were calculated to generate a uniform magnetic field (i.e., within 1 Gauss) for the longest distance parallel the z axis. The calculated desirable gaps are seen in FIG. 17 as the circles. In another embodiment, the gaps may be calculated according to a second order polynomial. By way of example, the desired gap spacings may be calculated according to $$\frac{\text{gap}}{gap_{baseline}} = c_1 + c_2\left|\frac{B}{B_{baseline}}\right| + c_3\left|\frac{B}{B_{baseline}}\right|^2,$$

where B is the magnetic field at a location along the magnetic assembly, $B_{baseline}$ is the baseline field at the center of the magnet assembly, and $gap_{baseline}$ is the gap that provides the baseline field at the center of the magnet assembly. It will be appreciated that depending upon the sizes, strengths, and shapes of the magnets of the magnet assembly, the constants $c_1$, $c_2$ and $c_3$ of the polynomial may change. By way of example, $c_1$, $c_2$ and $c_3$ could respectively be set to equal 0.133, 0.72 and 0.16.

In one embodiment, a "uniform" magnetic field is defined as within 1 Gauss of the base field. In another embodiment, a "uniform" magnetic field is defined as within 2 Gauss of the base field. In another embodiment, a "uniform" magnetic field is defined as within 1% of the base field.

In one possible embodiment, an assembly of spaced magnets can be realized by fixing the position of each component using a combination of glue, spacers and/or external supports. In some cases, and after a desirable and/or optimal ordering and spacing has been determined, it may be convenient to insert magnet pieces one by one into a hollow support frame (such as a parallelepiped and/or a hollow semi-cylindrical section), each followed by an appropriate spacer (e.g. plastic or other non-magnetic material) and glue. The next piece can then be introduced after the glue has cured, in some cases after applying a force to counteract magnetic repulsion between pieces.

In one possible aspect, to limit or truncate run-away errors due to stacking of multiple components over an extended length, the magnet assembly can also be created by combining shorter sub-sections, each including a smaller number of magnet unit cells in a standalone support frame. Each sub-section can be trimmed to meet length specifications in order to meet the desired spacing with respect to other magnet unit cells in next sub-section.

In one possible implementation, a distributed magnet assembly can include various similar (and/or analogous) elements separated by gaps, and/or with gaps inserted. The gaps can be tapered (i.e., increased or decreased in size as a function of direction), including with the given design rules such as proportionally to the local magnetic field, or proportionally to the difference between the local magnetic field and the desired (or target) magnetic field.

It will be understood that tapered gaps can include gaps with variable and/or non-uniform gap size.

In one aspect, gap spacing can lead to an extended uniform field region. More particularly, if a designer is constrained to use a given, fixed set of subcomponents in an assembly, an adaptive, compensative spacing scheme can be utilized to optimize as much as possible the field uniformity from the assembly, resulting in lower fabrication costs. In one aspect, post-fabrication carving of one or more slots in a ferromagnetic ring of a magnet assembly can be applied for a similar purpose.

In one implementation, for a given set of components (i.e. magnet blocks), the field distribution can be improved and/or optimized in the sense region (saddle, fixed gradient); the field profile can be improved and/or optimized axially, for a moving tool; and/or the depth of investigation of a tool can be improved and/or optimized using aspects of magnet design.

In one implementation, an algorithm can be used to generates gap sizes between uniform magnets of a magnet assembly as a function of local field values of the magnet assembly.

In one embodiment, aspects of magnet design can be used to improve and/or maximize a length of a uniform region relative to overall magnet length.

In one implementation, positioning screws, jacks or fixtures can be used. In one aspect, short subsections can be used in an assembly to limit run-away error.

In one aspect, the magnetic field uniformity along a desired axis such as a tool and/or flow-line axis can be customized and/or improved for various applications (including, for example, for use with NMR technologies), by introducing gaps between magnet pieces. Such a design concept can be applied to various applications, including, for example, NMR well logging tools, Halbach magnets and shim-a-ring magnets. In embodiments, the gaps may change in size as they extend away from the center of a magnet assembly.

In one aspect, the (gap) spacing may be gradual but not uniform, and can be further tuned upon obtaining specific information on the magnetization of the magnet sections selected, e.g., through simulation.

Other tuning methods can include, but are not limited to, moving segments gradually further away from the plane of the uniform field. In some implementations, the result can be a magnet in which less total magnet material is used to accomplish a magnetic field of considerable uniformity.

In one embodiment, an assembly of permanent magnet blocks interspaced by gaps (air, plastic, and/or other non-magnetic materials) can provide for an increased flexible and customizable effective magnetization density. This is generally a function of not only the size and magnetization of each block, but also of their relative positions. In one embodiment the size of each gap can be adjusted in a progressive manner (i.e. tapered) in order to increase, and/or optimize the field uniformity.

Several example applications using such tapering techniques are described below.

In one embodiment, starting from an assembly of magnet pieces or cells that are not spaced, i.e., in an unperturbed configuration, a desirable and/or optimal separation between each magnet piece can be determined by adjusting each gap proportionally to the value of magnetic field in the unperturbed configuration. As a result, the extent and uniformity of a field sense region can be increased and/or maximized when the gap between components is adjusted proportionally to the unperturbed magnetic field (see, for example, FIG. 17).

In one implementation, a progressive tapering of the distance between magnet blocks can increase and/or optimize the extent of the uniform region. This tapering may include a progressively increasing axial distance between blocks, starting from the center. This can be used, for example, where the magnet blocks are parallel to each other and polarized radially, positioned so as to give a uniform field along y-direction, at some distance from the tool axis. On the other hand, the tapering may also include a progressive decrease of the axial distance between blocks, starting from the center of the assembly, such as when the magnet blocks are positioned collinearly and polarized transversely to the axial direction so as to give a uniform field along the x-direction.

In one aspect, the design approach featuring distributed magnet assemblies can offer a number of advantages over more conventional designs, where the magnet pieces are closely packed together. One advantage is that the extent of the uniform field along an axis parallel to the magnet assembly is increased. This effect can be particularly desirable for a fast moving NMR sensor, such as borehole logging NMR tool. For a moving NMR tool, the time available for a measurement can be limited by $\Delta t = L/v$, where L is the extent of tool sense region (i.e. the region of uniform field or gradient field) and v is the logging speed. A longer sense region may thus be desirable to either increase sensitivity, SNR or allow for faster speeds. With a traditional magnet assembly, an extended sense region comes at the cost of a long, expensive and heavy magnet.

Figure 18:
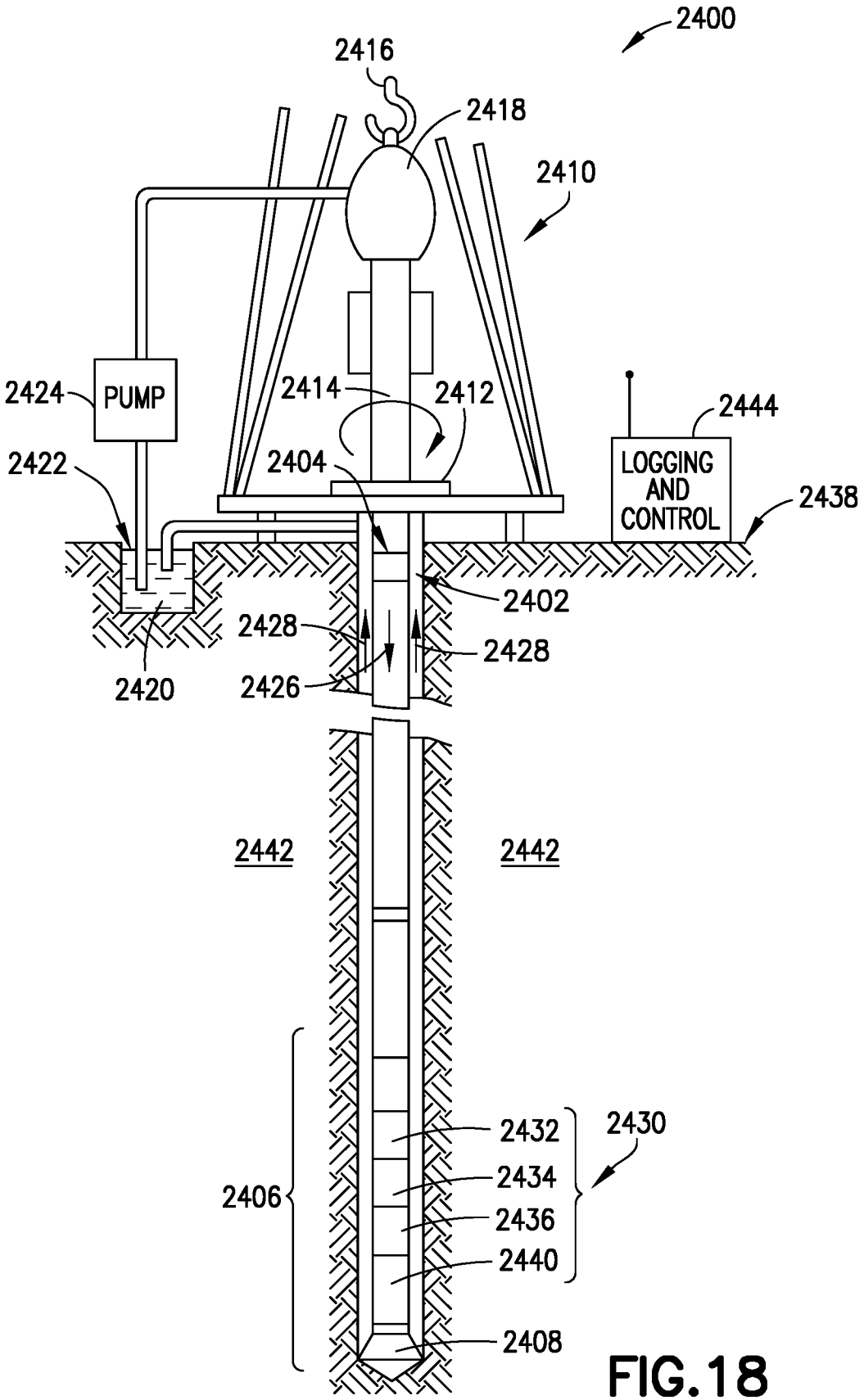
FIG. 18 illustrates an example wellsite in which embodiments of magnet design can be employed.

FIG. 18 illustrates a wellsite 2400 in which embodiments of a magnet design as according to any of the previous embodiments can be employed. Wellsite 2400 can be onshore or offshore. In this example system, a borehole 2402 is formed in a subsurface formation by rotary drilling in a manner that is well known. Embodiments of magnet design can also be employed in association with wellsites where directional drilling is being conducted.

A drill string 2404 can be suspended within borehole 2402 and have a bottom hole assembly 2406 including a drill bit 2408 at its lower end. The surface system can include a platform and derrick assembly 2410 positioned over the borehole 2402. The assembly 2410 can include a rotary table 2412, kelly 2414, hook 2416 and rotary swivel 2418. The drill string 2404 can be rotated by the rotary table 2412, energized by means not shown, which engages the kelly 2414 at an upper end of drill string 2404. Drill string 2404 can be suspended from hook 2416, attached to a traveling block (also not shown), through kelly 2414 and a rotary swivel 2418 which can permit rotation of drill string 2404 relative to hook 2416. As is well known, a top drive system can also be used.

In the example of this embodiment, the surface system can further include drilling fluid or mud 2420 stored in a pit 2422 formed at wellsite 2400. A pump 2424 can deliver drilling fluid 2420 to an interior of drill string 2404 via a port in swivel 2418, causing drilling fluid 2420 to flow downwardly through drill string 2404 as indicated by directional arrow 2426. Drilling fluid 2420 can exit drill string 2404 via ports in drill bit 2408, and circulate upwardly through the annulus region between the outside of drill string 2404 and wall of the borehole 2402, as indicated by directional arrows 2428. In this well-known manner, drilling fluid 2420 can lubricate drill bit 2408 and carry formation cuttings up to the surface as drilling fluid 2420 is returned to pit 2422 for recirculation.

Bottom hole assembly 2406 of the illustrated embodiment can include drill bit 2408 as well as a variety of equipment 2430, including a logging-while-drilling (LWD) module 2432, a measuring-while-drilling (MWD) module 2434, a roto-steerable system and motor, various other tools, etc.

In one possible implementation, LWD module 2432 can be housed in a special type of drill collar, as is known in the art, and can include one or more of a plurality of different logging tools such as a nuclear magnetic resonance (NMR system) tool utilizing a magnet assembly described with respect to any of the previously described embodiments, a directional resistivity system, and/or a sonic logging system, etc. LWD module 2432 can include capabilities for measuring, processing, and storing information, as well as for communicating with surface equipment.

MWD module 2434 can also be housed in a special type of drill collar, as is known in the art, and include one or more devices for measuring characteristics of the well environment, such as characteristics of the drill string and drill bit. MWD module 2434 can further include an apparatus (not shown) for generating electrical power to the downhole system. This may include a mud turbine generator powered by the flow of drilling fluid 2420, it being understood that other power and/or battery systems may be employed. MWD module 2434 can include one or more of a variety of measuring devices known in the art including, for example, a weight-on-bit measuring device, a torque measuring device, a vibration measuring device, a shock measuring device, a stick slip measuring device, a direction measuring device, and an inclination measuring device.

It will also be understood that more than one LWD and/or MWD module can be employed. Thus, module 2436 may include another LWD and/or MWD module such as described with reference to modules 2432 and 2434.

Various systems and methods can be used to transmit information (data and/or commands) from equipment 2430 to a surface 2438 of the wellsite 2400. In one implementation, information can be received by one or more sensors 2440. The sensors 2440 can be located in a variety of locations and can be chosen from any sensing and/or detecting technology known in the art, including those capable of measuring various types of radiation, electric or magnetic fields, including electrodes (such as stakes), magnetometers, coils, etc.

In one possible implementation, information from equipment 2430, including LWD data and/or MWD data, can be utilized for a variety of purposes including steering drill bit 2408 and any tools associated therewith, characterizing a formation 2442 surrounding borehole 2402, characterizing fluids within borehole 2402, etc. For example, information from equipment 2430 can be used to create one or more sub-images of various portions of borehole 2402.

In one implementation a logging and control system 2444 can be present. Logging and control system 2444 can receive and process a variety of information from a variety of sources, including equipment 2430. Logging and control system 2444 can also control a variety of equipment, such as equipment 2430 and drill bit 2408.

Logging and control system 2444 can also be used with a wide variety of oilfield applications, including logging while drilling, artificial lift, measuring while drilling, wireline, etc. Also, logging and control system 2444 can be located at surface 2438, below surface 2438, proximate to borehole 2402, remote from borehole 2402, or any combination thereof.

For example, in one possible implementation, information received by equipment 2430 and/or sensors 2440 can be processed by logging and control system 2444 at one or more locations, including any configuration known in the art, such as in one or more handheld devices proximate and/or remote from the wellsite 2400, at a computer located at a remote command center, etc. In one aspect, logging and control system 2444 can be used to create images of borehole 2402 and/or formation 2442 from information received from, for example equipment 2430 and/or from various other tools, including wireline tools. In one possible implementation, logging and control system 2444 can also perform various aspects of magnet design, as described herein, to process various measurements and/or information.

In other embodiments, a borehole tool comprises a nuclear magnetic resonance (NMR system) tool utilizing a magnet assembly described with respect to any of the previously described embodiments.

Figure 19:
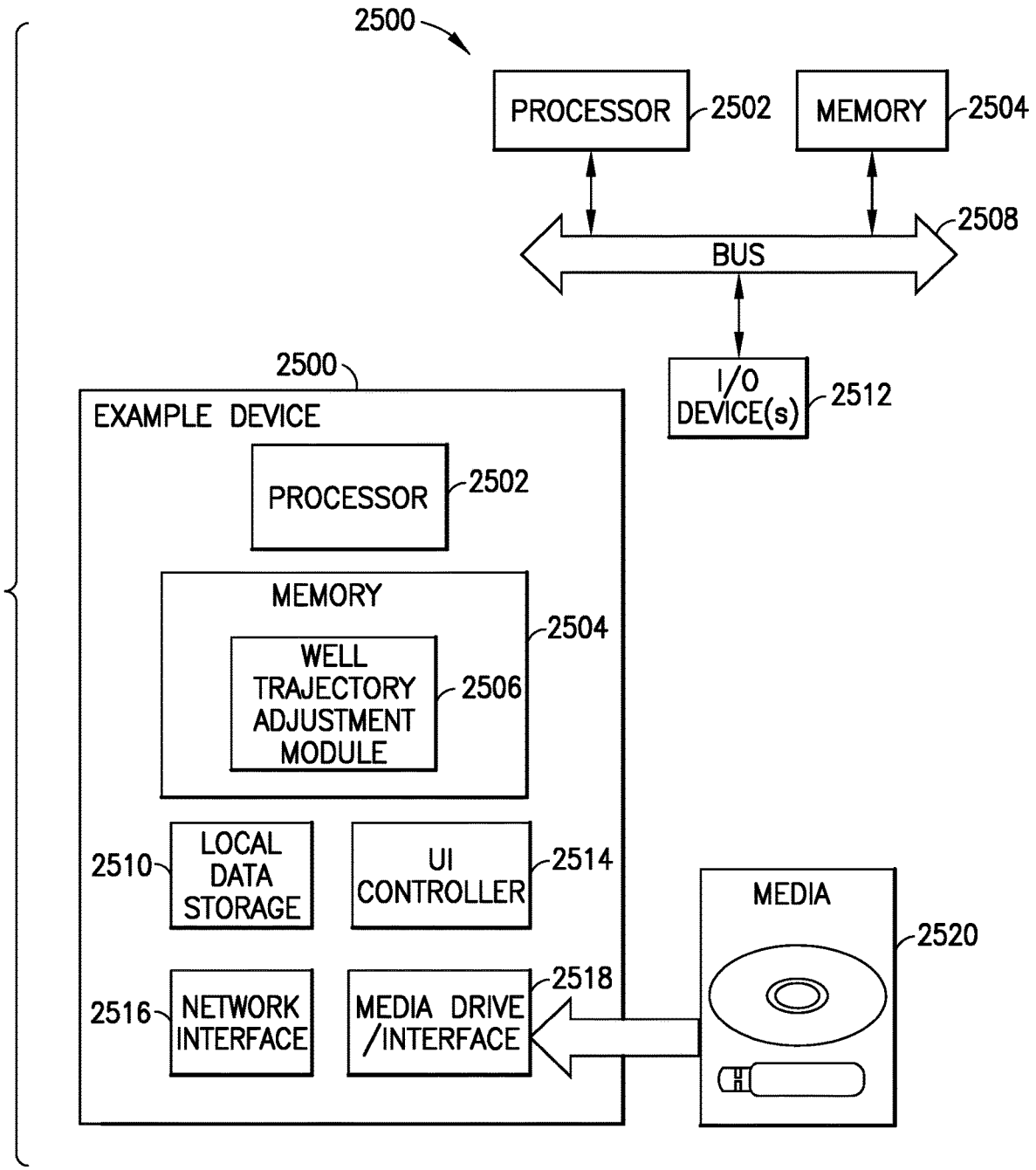
FIG. 19 illustrates an example computing device that can be used in accordance with various implementations of magnet design.

FIG. 19 illustrates an example device 2500, with a processor 2502 and memory 2504 for hosting a magnet design module 2506 configured to implement various embodiments of magnet assembly design as discussed in this disclosure. Memory 2504 can also host one or more databases and can include one or more forms of volatile data storage media such as random access memory (RAM), and/or one or more forms of nonvolatile storage media (such as read-only memory (ROM), flash memory, and so forth).

Device 2500 is one example of a computing device or programmable device, and is not intended to suggest any limitation as to scope of use or functionality of device 2500 and/or its possible architectures. For example, device 2500 can comprise one or more computing devices, programmable logic controllers (PLCs), etc.

Further, device 2500 should not be interpreted as having any dependency relating to one or a combination of components illustrated in device 2500. For example, device 2500 may include one or more of a computer, such as a laptop computer, a desktop computer, a mainframe computer, etc., or any combination or accumulation thereof.

Device 2500 can also include a bus 2508 configured to allow various components and devices, such as processors 2502, memory 2504, and local data storage 2510, among other components, to communicate with each other.

Bus 2508 can include one or more of any of several types of bus structures, including a memory bus or memory controller, a peripheral bus, an accelerated graphics port, and a processor or local bus using any of a variety of bus architectures. Bus 2508 can also include wired and/or wireless buses.

Local data storage 2510 can include fixed media (e.g., RAM, ROM, a fixed hard drive, etc.) as well as removable media (e.g., a flash memory drive, a removable hard drive, optical disks, magnetic disks, and so forth).

One or more input/output (I/O) device(s) 2512 may also communicate via a user interface (UI) controller 2514, which may connect with I/O device(s) 2512 either directly or through bus 2508.

In one possible implementation, a network interface 2516 may communicate outside of device 2500 via a connected network, and in some implementations may communicate with hardware, such as equipment 2430, one or more sensors 2440, etc.

In one possible embodiment, equipment 2430 may communicate with device 2500 as input/output device(s) 2512 via bus 2508, such as via a USB port, for example.

A media drive/interface 2518 can accept removable tangible media 2520, such as flash drives, optical disks, removable hard drives, software products, etc. In one possible implementation, logic, computing instructions, and/or software programs comprising elements of magnet design module 2506 may reside on removable media 2520 readable by media drive/interface 2518.

In one possible embodiment, input/output device(s) 2512 can allow a user to enter commands and information to device 2500, and also allow information to be presented to the user and/or other components or devices. Examples of input device(s) 2512 include, for example, sensors, a keyboard, a cursor control device (e.g., a mouse), a microphone, a scanner, and any other input devices known in the art. Examples of output devices include a display device (e.g., a monitor or projector), speakers, a printer, a network card, and so on.

Various processes of magnet design module 2506 may be described herein in the general context of software or program modules, or the techniques and modules may be implemented in pure computing hardware. Software generally includes routines, programs, objects, components, data structures, and so forth that perform particular tasks or implement particular abstract data types. An implementation of these modules and techniques may be stored on or transmitted across some form of tangible computer-readable media. Computer-readable media can be any available data storage medium or media that is tangible and can be accessed by a computing device. Computer readable media may thus comprise computer storage media. "Computer storage media" designates tangible media, and includes volatile and non-volatile, removable and non-removable tangible media implemented for storage of information such as computer readable instructions, data structures, program modules, or other data. Computer storage media include, but are not limited to, RAM, ROM, EEPROM, flash memory or other memory technology, CD-ROM, digital versatile disks (DVD) or other optical storage, magnetic cassettes, magnetic tape, magnetic disk storage or other magnetic storage devices, or any other tangible medium which can be used to store the desired information, and which can be accessed by a computer.

In one possible implementation, device 2500, or a plurality thereof, can be employed at wellsite 2400. This can include, for example, in various equipment 2430, in logging and control system 2444, etc.

Although a few example embodiments have been described in detail above, those skilled in the art will readily appreciate that many modifications are possible in the example embodiments without materially departing from this disclosure. Accordingly, such modifications are intended to be included within the scope of this disclosure as defined in the following claims. Moreover, embodiments may be performed in the absence of any component not explicitly described herein.

In the claims, means-plus-function clauses are intended to cover the structures described herein as performing the recited function and not just structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words 'means for' together with an associated function.

The invention claimed is:

1. A method comprising:

obtaining a plurality of uniform magnet pieces; and assembling the uniform magnet pieces as a magnet assembly with at least one gap between the magnet pieces, wherein the assembling includes selecting a respective width for each at least one gap, wherein the magnet pieces of the magnet assembly are arranged linearly, wherein the at least one gap comprises a plurality of gaps with at least one center gap, and wherein the widths of the gaps are based on a function of a magnetic field at a location along the magnetic assembly, a baseline magnetic field at the center of the magnetic assembly, and a gap that provides the baseline magnetic field at the center of the magnetic assembly.

2. The method of claim 1, wherein the magnet pieces comprise at least four magnet pieces, and the at least one gap comprises at least three gaps with at least one center gap, wherein the widths of the gaps on either side of a center gap are larger than the width of the center gap.

3. The method of claim 2, wherein the magnet pieces comprise more than four magnet pieces, and the at least one gap comprises more than three gaps, wherein the widths of the gaps increase as they extend away from the center gap.

4. The method of claim 2, wherein the widths of the gaps are chosen according to a second order polynomial that relates the magnetic field at the location along the magnetic assembly, the baseline magnetic field at the center of the magnetic assembly, and the gap that provides the baseline magnetic field at the center of the magnetic assembly.

5. The method of claim 4, wherein the second order polynomial is defined according to $$\frac{\text{gap}}{gap_{baseline}} = c_1 + c_2\left|\frac{B}{B_{baseline}}\right| + c_3\left|\frac{B}{B_{baseline}}\right|^2$$

where B is the magnetic field at a location along the magnetic assembly, $B_{baseline}$ is the baseline magnetic field at the center of the magnet assembly, $gap_{baseline}$ is the gap that provides the baseline magnetic field at the center of the magnet assembly, and $c_1$, $c_2$ and $c_3$ are constants.

6. The method of claim 1, wherein the selecting a respective width for each at least one gap comprises modeling magnet assemblies with the size, shape and magnetism of the magnet pieces as inputs to a model, and with gap width as a variable, and finding at least one respective gap width that optimizes a length of uniformity of a resulting magnetic field region of the magnet assembly.

7. The method of claim 1, wherein the magnet pieces each comprise magnetic segments arranged in a U-shape.

8. The method of claim 7, further comprising placing non-magnetic spacers between the U-shaped magnetic segments.

9. The method of claim 1, wherein the magnet pieces of the magnet assembly are each toroidal.

10. A magnet assembly, comprising:

a plurality of uniform magnet pieces arranged with at least one gap between the magnet pieces, wherein the magnet pieces of the magnet assembly are arranged linearly, wherein the at least one gap comprises a plurality of gaps with at least one center gap, and wherein widths of the gaps are based on a function of a magnetic field at a location along the magnetic assembly, a baseline magnetic field at the center of the magnetic assembly, and a gap that provides the baseline magnetic field at the center of the magnetic assembly.

11. The magnet assembly of claim 10, wherein the magnet pieces comprise more than four magnet pieces arranged linearly, and the at least one gap comprises more than three gaps, wherein the widths of the gaps increase as they extend away from a center gap.

12. The magnet assembly of claim 11, wherein the widths of the gaps follow a second order polynomial that relates the magnetic field at the location along the magnetic assembly, the baseline magnetic field at the center of the magnetic assembly, and the gap that provides the baseline magnetic field at the center of the magnetic assembly.

13. The magnet assembly of claim 12 wherein the second order polynomial is defined according to $$\frac{\text{gap}}{gap_{baseline}} = c_1 + c_2\left|\frac{B}{B_{baseline}}\right| + c_3\left|\frac{B}{B_{baseline}}\right|^2$$

where B is the magnetic field at a location along the magnetic assembly, $B_{baseline}$ is the baseline field at the center of the magnet assembly, $gap_{baseline}$ is the gap that provides the baseline field at the center of the magnet assembly, and $c_1$, $c_2$ and $c_3$ are constants.

14. The magnet assembly of claim 10, wherein the magnet pieces comprise toroidal magnet pieces.

* * * * *